US010238220B2

(12) United States Patent
Durant

(10) Patent No.: US 10,238,220 B2
(45) Date of Patent: Mar. 26, 2019

(54) METHODS AND ASSEMBLIES FOR DISPLAYING IMAGES

(71) Applicant: Silas Jeffrey Durant, Scottdale, GA (US)

(72) Inventor: Silas Jeffrey Durant, Scottdale, GA (US)

( * ) Notice: Subject to any disclaimer, the term of this patent is extended or adjusted under 35 U.S.C. 154(b) by 0 days.

(21) Appl. No.: 15/048,459

(22) Filed: Feb. 19, 2016

(65) Prior Publication Data

US 2016/0242577 A1 Aug. 25, 2016

Related U.S. Application Data

(63) Continuation of application No. 14/056,594, filed on Oct. 17, 2013, now Pat. No. 9,265,365.

(60) Provisional application No. 61/715,551, filed on Oct. 18, 2012.

(51) Int. Cl.

| | |
|---|---|
| ***A47G 1/06*** | (2006.01) |
| ***G09F 11/04*** | (2006.01) |
| ***G09F 11/06*** | (2006.01) |

(52) U.S. Cl.

CPC ..... *A47G 1/065* (2013.01); *A47G 1/06* (2013.01); *G09F 11/04* (2013.01); *G09F 11/06* (2013.01)

(58) Field of Classification Search

CPC ..... A47G 1/16; A47G 1/1606; A47G 1/1613; A47G 1/164; A47G 1/166; G09F 2007/1891

See application file for complete search history.

(56) References Cited

U.S. PATENT DOCUMENTS

| | | | | | |
|---|---|---|---|---|---|
| 2,569,622 | A * | 10/1951 | Trainor | A47G 1/1613 | 248/297.21 |
| 4,858,351 | A * | 8/1989 | Sewell | F16B 21/16 | 248/489 |
| 4,883,247 | A * | 11/1989 | Crandall | A47G 1/1613 | 248/489 |
| 4,898,560 | A * | 2/1990 | Moscovich | A63F 9/0613 | 359/850 |
| 5,408,774 | A * | 4/1995 | Grewe | G09F 15/00 | 248/349.1 |
| 6,719,260 | B1 * | 4/2004 | Hart | A47G 1/168 | 248/466 |
| 6,792,707 | B1 * | 9/2004 | Setteducati | G09F 19/14 | 359/831 |

(Continued)

*Primary Examiner* — Gary C Hoge

(74) *Attorney, Agent, or Firm* — Ballard Spahr LLP

(57) ABSTRACT

Methods and assemblies are provided for displaying a plurality of images, which can be mirror images of each other. The method includes providing a first display object having a first image on it and providing a second display object having a second image on it. The first and second images are mirror images of each other. The first and second display objects are positioned such that the images are displayed in a first mirrored registration. After doing so, the first and second display objects are repositioned such that the first and second images are displayed in a second mirrored registration. Assemblies can include at least one mount, a first display object having a first image disposed thereon, and a second display object having a second image disposed thereon, the images being mirror images of each other. The first and second display objects are movably attached to the mount.

9 Claims, 28 Drawing Sheets

(56) References Cited

U.S. PATENT DOCUMENTS

| | | | | |
|---|---|---|---|---|
| 6,799,515 | B2 * | 10/2004 | Lynn | B44F 1/066 101/483 |
| 7,509,763 | B1 * | 3/2009 | Alverson | G09F 7/00 40/605 |
| 2002/0162925 | A1 * | 11/2002 | Song | A47G 1/1606 248/223.41 |
| 2003/0145497 | A1 * | 8/2003 | Leslie | G09F 11/23 40/495 |
| 2005/0223611 | A1 * | 10/2005 | Dennis | A47G 1/065 40/729 |
| 2011/0138666 | A1 * | 6/2011 | Borde | A47G 1/166 40/747 |
| 2011/0290965 | A1 * | 12/2011 | Virgin | A47G 1/1606 248/205.3 |
| 2012/0112022 | A1 * | 5/2012 | Cheng | A47G 7/044 248/205.3 |
| 2013/0097906 | A1 * | 4/2013 | Schultz | A47G 1/0605 40/747 |
| 2013/0161473 | A1 * | 6/2013 | Gandiboyina | A47G 1/08 248/467 |
| 2014/0115935 | A1 * | 5/2014 | Mason | A47G 1/1606 40/711 |

* cited by examiner

800

METHODS AND ASSEMBLIES FOR DISPLAYING IMAGES

CROSS REFERENCE TO RELATED APPLICATIONS

This application is a continuation of and claims the benefit of priority to co-pending U.S. patent application Ser. No. 14/056,594, filed Oct. 17, 2013, which application claims the benefit of priority to U.S. Provisional Application No. 61/715,551, filed on Oct. 18, 2012, the disclosures of which are incorporated herein by reference in their entirety.

FIELD OF THE INVENTION

Provided are methods and assemblies for displaying images. More specifically, methods and assemblies are provided for displaying mirror images in an interactive and entertaining manner, by enabling the images to be repositioned by a user.

BACKGROUND OF THE INVENTION

Over the past several decades, people have been increasingly engaged by visual media, particularly interactive media such as televisions, computer games, and video games. Most can affirm that if a television is on, it is almost impossible not to look at it. The human eye is attracted to light, especially if that light is constantly changing and flickering. The human eye is also attracted to movement. Objects that move tend to get noticed. When something moves, there is an involuntary response of the eye to investigate and discover the cause. This is particularly true when there is a purpose and a precision to that movement. Thus, products that encourage interaction are more likely to attract and maintain attention of a user.

As this type of moving and interactive media continues to become prevalent in our society, less attention is paid to traditionally "stagnant" media, such as photographs, paintings, and the like.

Thus, there is a need in the art for ways of displaying traditionally stagnant media in a way that is interactive and able to be manipulated or moved.

SUMMARY

In accordance with the purposes of this invention, as embodied and broadly described herein, this invention, in one aspect, relates to methods and assemblies for displaying a plurality of images. The method can comprise providing a first display object having a first image disposed on it and providing a second display object having a second image disposed on it. Both the first and second display objects can have respective first peripheral surfaces. The first and second images are, in one aspect, mirror images of each other. The method can further comprise positioning the first and second display objects such that the first and second images are displayed in a first mirrored registration about a first axis of symmetry. After doing so, the first and second display objects can be repositioned such that the first and second images are displayed in a second mirrored registration about a second axis of symmetry.

Also provided are assemblies for displaying at least one image on a surface. An exemplary assembly can comprise a mount configured to attach to the surface, and a display object on which the image is disposed. The display object can be movably attached to the mount. Another exemplary assembly is provided for displaying a plurality of images, and comprises at least one mount, a first display object having a first image disposed thereon, and a second display object having a second image disposed thereon. The first and second display objects are movably attached to the at least one mount. In a further aspect, the first image is a mirror image of the second image.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DETAILED DESCRIPTION

Figure 1A:
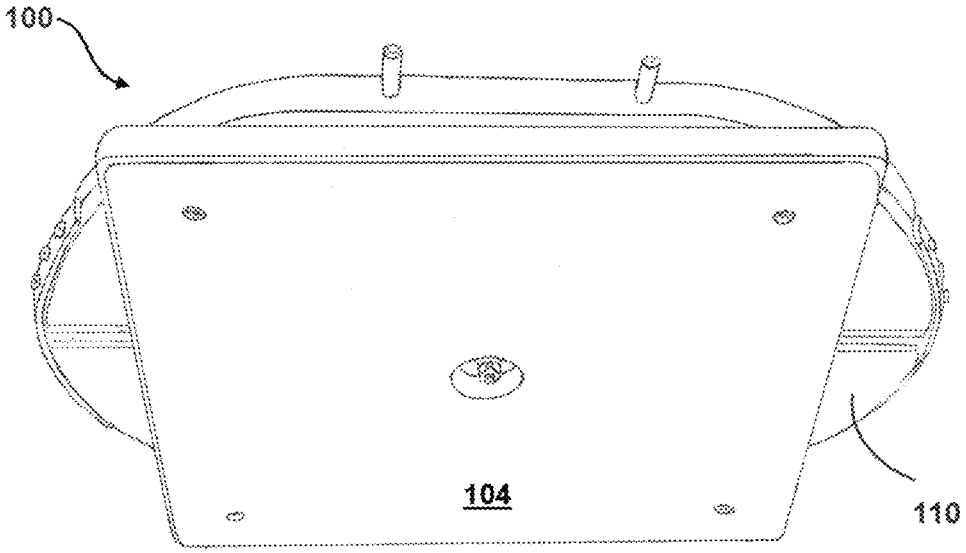
FIG. 1A is a front perspective view of an assembly for displaying an image, the assembly having a first member shown in a first position, according to one embodiment.

The present invention may be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

As used in the specification and the appended claims, the singular forms "a," "an" and "the" include plural referents unless the context clearly dictates otherwise. Thus, for example, reference to a "panel" can include two or more such panels unless the context indicates otherwise.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Reference will now be made in detail to the present preferred aspects of the invention, examples of which are illustrated in the accompanying drawings. Wherever possible, the same reference numbers are used throughout the drawings to refer to the same or like parts.

Provided herein are methods and assemblies for displaying a plurality of images. The images can be any graphic, such as a piece of artwork (i.e., a painting, photograph, sketch, collage, etc.), or any other visual presentation. As discussed further herein, in various embodiments, at least two of the images are mirror images of each other. Mirrored images have a unique ability to affect eye movement patterns. The eye is continuously pulled toward the center, or the line of symmetry. As the eye moves to one side of a mirrored image, the eye will tend to be pulled back toward the line of symmetry. Symmetry has also traditionally been thought of as a defining component of beauty, and people are naturally drawn toward symmetrically balanced shapes and compositions.

Similarly, the methods and assemblies described herein allow a user to have an interactive experience between an image and the viewer of that object. Usually, one sits passively as an observer of an image. This is a one-way conversation. The assemblies described herein are designed to be manipulated by a user, creating a two-way communication or dialogue. The passive observer becomes an active participant.

Exemplary methods can comprise providing a first display object having a first image disposed on it. The display object has at least a first peripheral surface. A second display object is provided having a second image depicted on it. The second display object also has a respective first peripheral surface. In one aspect, the first image and second image are mirror images of each other about a plurality of axes of symmetry. The method further comprises positioning the first and second display objects such that the first and second images are displayed in a first mirrored registration about a first axis of symmetry. After the first and second images are displayed in the first mirrored registration, the images can be selectively repositioned such that the first and second images are displayed in a second mirrored registration about a second axis of symmetry.

In one aspect, the first peripheral surface of the first display object has a first side edge, and the first image extends to the first display object first side edge. Similarly, the first peripheral surface of the second display object has a first side edge, and the second image extends to the second display object first side edge. In a further aspect, the first axis of symmetry extends along the respective first side edges of each of the first and second display objects. The first peripheral surfaces of the first and second display objects can also have second side edges. The first image can extend to the first display object second side edge, and the second image can extend to the second display object second side edge. The second axis of symmetry can extend along the respective second side edges of each of the first and second display objects.

It is contemplated that the display objects described herein can be of a variety of shapes or sizes, and can include a number of different objects on which an image can be displayed. For example, and not meant to be limiting, the display objects can be substantially planar and can have at least one outer edge. Thus, the display objects could be circular, oval-shaped, elliptical, and have one peripheral surface that defines one continuous edge. Optionally, the display objects can be polygons having at least three sides, such as a triangle, quadrilateral (square, rectangle, diamond, etc.), pentagon, hexagon, heptagon, octagon, etc. In a further aspect, the first display object and second display object are each a polygon shape having identical size and shape. In yet another aspect, the display objects may be substantially non-planar, and can be cylindrical, spherical, or another shape. The image can be depicted on at least a portion of the curved surface of such a non-planar display object.

According to a further aspect, the first and second display objects can be substantially planar four-sided polygons, such that the first peripheral surface of the first display object has at least four side edges, and the first image disposed thereon can extend to each of the first display object side edges. Similarly, the first peripheral surface of the second display object can have at least four side edges, and the second image disposed thereon can extend to each of the second display object side edges. An axis of symmetry can extend along each of the respective side edges of each of the first and second display objects.

According to any of the above-referenced aspects, in the first registration, at least a portion of the respective first peripheral surfaces substantially abut each other. Similarly, in the second registration, at least a portion of the respective first peripheral surfaces substantially abut each other. In a particular aspect, wherein each first peripheral surface has a first side edge and a second side edge, in the first registration, the respective first side edges of the first and second display objects substantially abut each other, and in the second registration, the respective second side edges of the first and second display objects substantially abut each other. In other aspect, in the first and/or second registrations, the first peripheral surfaces can be spaced from one another.

Provided herein are assemblies for displaying at least one image. Exemplary assemblies can be used to accomplish the methods described herein above. According to various aspects, the assemblies can be used to display the image on a surface, such as, but not limited to, a wall or other vertical surface. However, it is contemplated that the assembly can be used to display the image on a horizontal surface, slanted surface, etc.

Exemplary assemblies can include a mount configured to attach to the surface, and a first display object on which the image is disposed. The first display object can be configured to movably attach to the mount. In one aspect, the first display object further comprises a first member, that is movably attached to the mount. It is contemplated that display objects described herein can be any surface or medium upon which an image can be disposed, including conventional materials (canvas, paper, wood, etc.), as well as electronic means (such as a television, computer monitor, etc.).

Figure 1B:
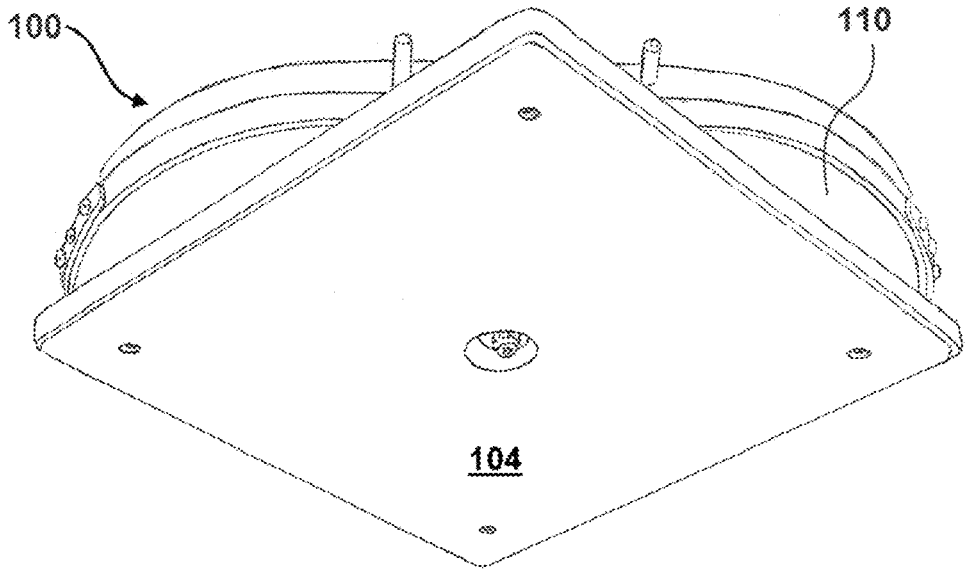
FIG. 1B is a front perspective view of the assembly of FIG. 1A, showing the first member in a second position.
Figure 1C:
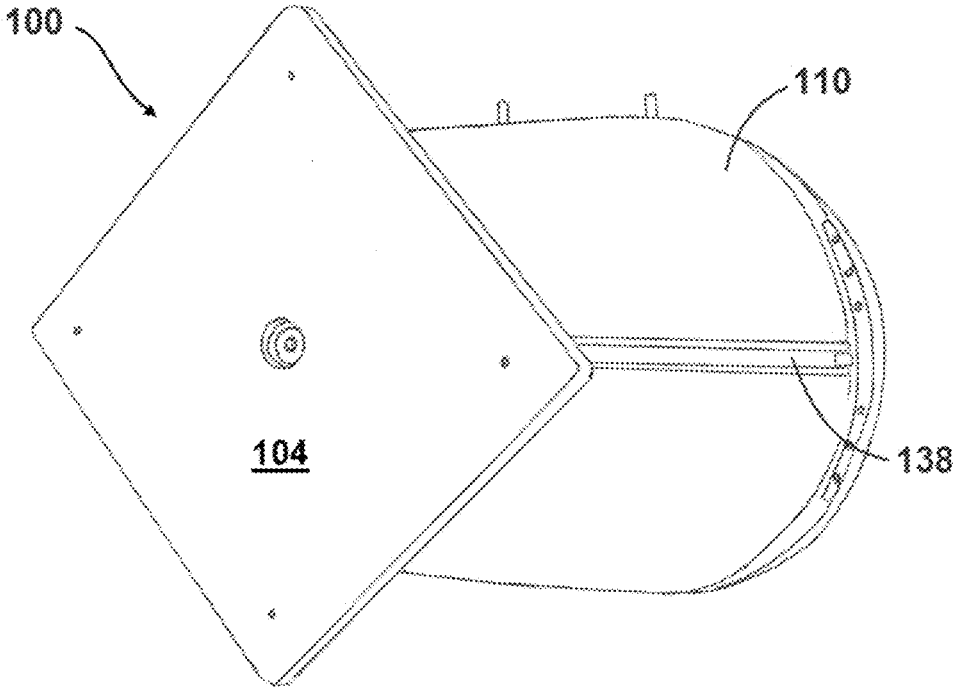
FIG. 1C is a front perspective view of the assembly of FIG. 1A, showing the first member in a third position.
Figure 1D:
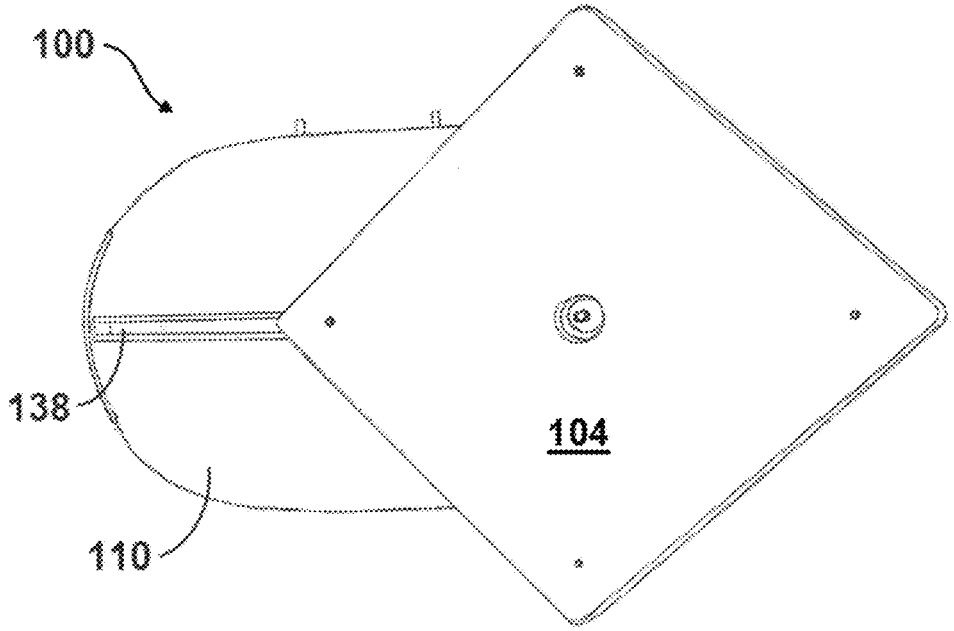
FIG. 1D is a front perspective view of the assembly of FIG. 1A, showing the first member in a fourth position.
Figure 2A:
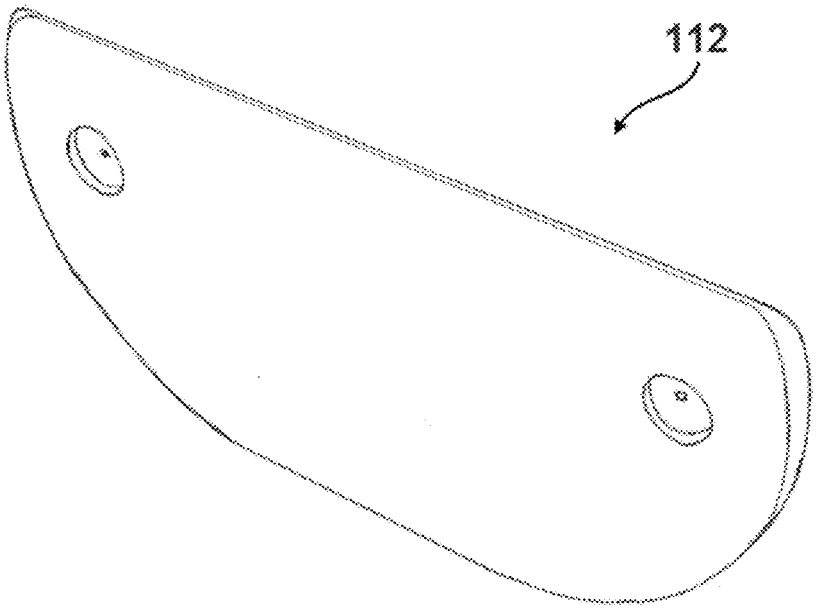
FIG. 2A is a front perspective view of a panel of the assembly of FIG. 1A, according to one embodiment.
Figure 2B:
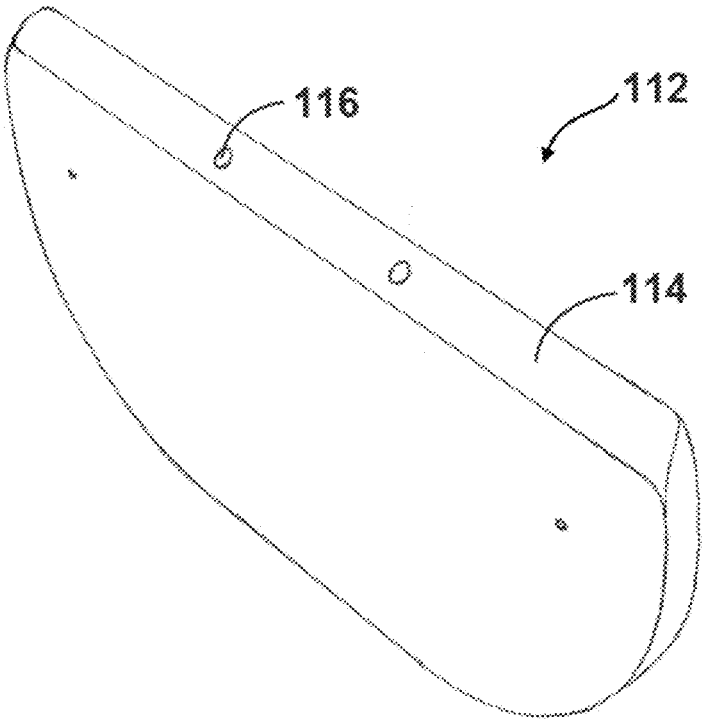
FIG. 2B is a rear perspective view of the panel of FIG. 2A.

For example, with reference to FIGS. 1A-1D, a partial assembly 100 is shown that comprises a mount 110 and a first member 104, that itself is a component of a display object. An exemplary first display object 120*a* can be seen in FIG. 4. The mount 110 can be configured to attach to a surface, and the first member 104 can be movably attached to the mount. In one aspect, the first member 104 can be rotatably attached to the mount. For example, as can be seen in FIGS. 1A and 1B, the first member can rotate about a fixed point. In another aspect, the first member can be slidably attached to the mount. For example, as can be seen in FIGS. 1C and 1D, the first member can slide from one position to another position along the mount. As can be appreciated, in one aspect (and as shown in FIGS. 1A-1D), the first member 104 can be rotatably and slidably attached to the mount.

Figure 3A:
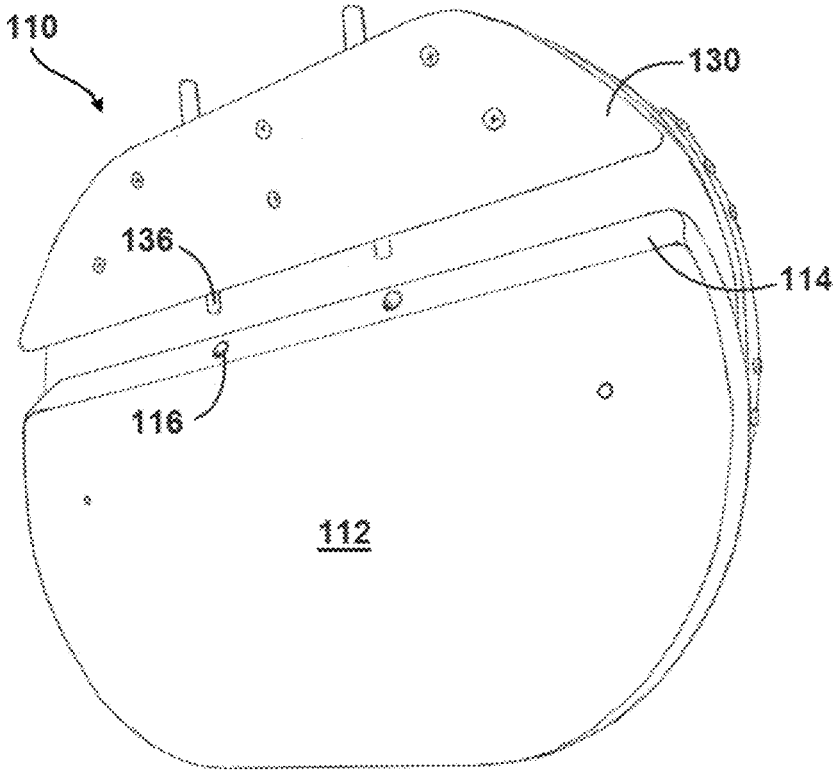
FIG. 3A is a rear perspective view of a partially disassembled mount of the assembly of FIG. 1A, including the panel of FIG. 2A, according to one embodiment.
Figure 3B:
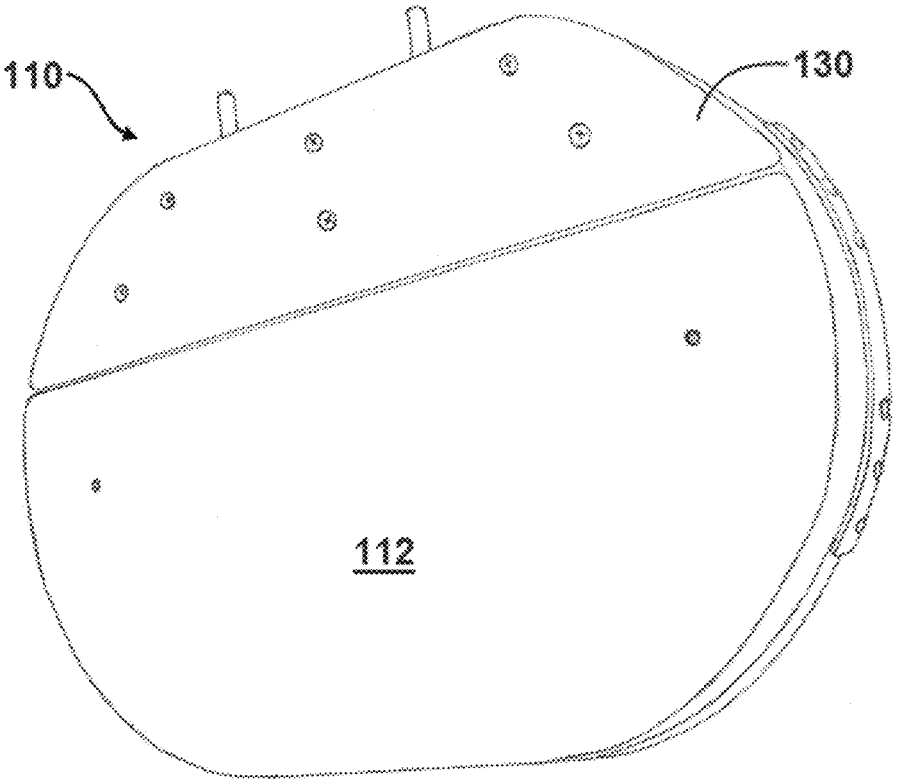
FIG. 3B is a rear perspective view of the mount of FIG. 3B in an assembled position.
Figure 3C:
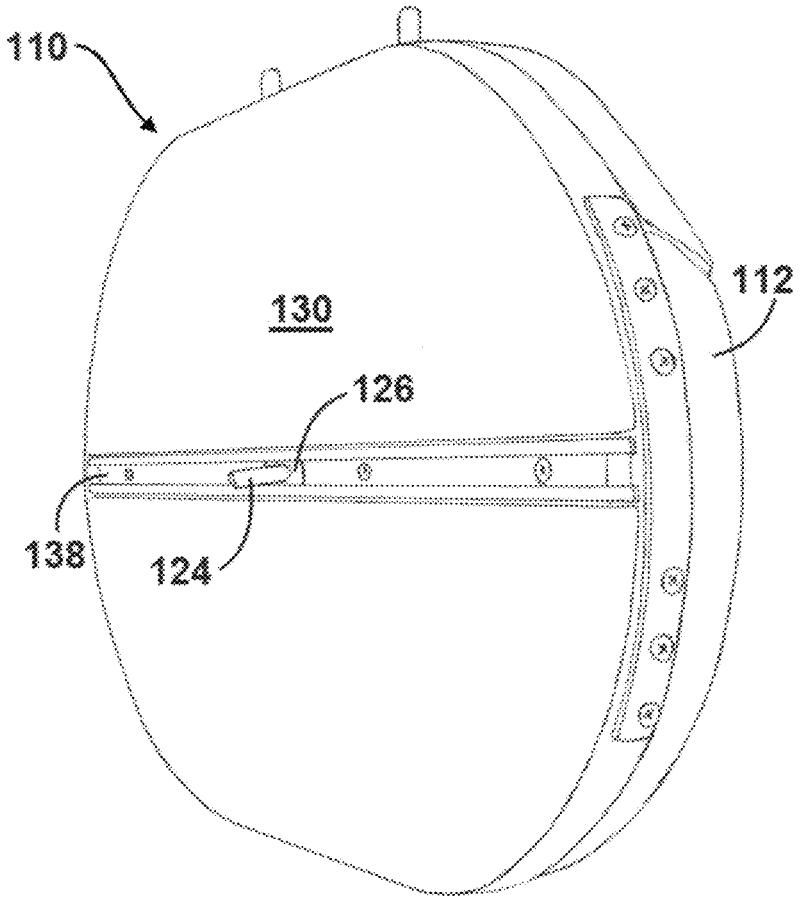
FIG. 3C is a front perspective view of the mount of FIG. 3C in an assembled position.

The slidable attachment between the first member and the mount can be achieved by means of a groove 138 defined in the mount that is configured to receive a portion of the assembly that is connected to the first member. For example, as shown in FIG. 3C, the assembly can comprise a connecting arm that extends from the first member (not shown) and comprises a pin 124 and a head 126, wherein the head is positioned at one end of the pin distal from the first member. The groove 138 can then be configured to slidably receive at least a portion of the connecting arm. As can be appreciated, the groove can be generally C-shaped in cross-section, such that an opening of the groove has a first dimension that is smaller than a dimension of an inner portion of the groove. The groove can then be sized and shaped to receive and retain the head of the connecting arm, which has a cross dimension larger than the diameter of the pin.

According to another aspect, and with reference to FIGS. 2A-2B and 3A-3C, the mount can comprise a panel 112 that is configured to attach to the surface, and a second member 130 that is configured to matingly engage the panel. For example, the panel 112 can have a first surface 114, and the second member 130 can have a mating surface 134 that is configured to engage the first surface. The first surface can further define at least one bore 116, and the mating surface can comprise at least one post 136 that is sized and shaped to be received by the at least one bore.

Figure 4:
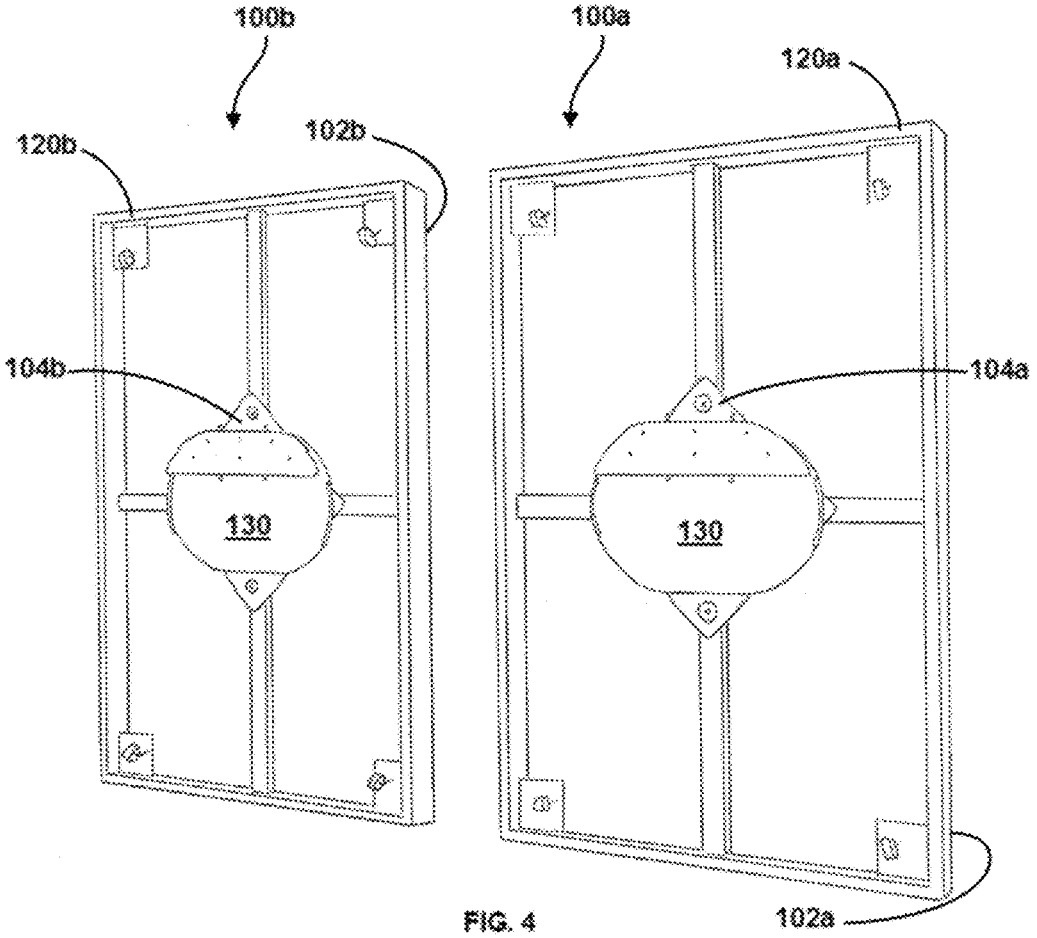
FIG. 4 is a rear perspective view of two images mounted to portions of exemplary assemblies for displaying an image, according to another embodiment.

As can be seen in FIG. 4, two assemblies 100*a*, 100*b* are provided for displaying a first image 102*a* and a second image 102*b*, respectively. Each assembly 100 comprises a display object 120 on which a respective image 102 is disposed. Each display object 120 comprises a respective first member 104 that can be attached to a second member 130 as discussed above. Each display object, in this aspect, is rectangular and is substantially planar in that it has a substantially planar surface on which the image is disposed. Each display object has a respective first peripheral surface, which in one aspect, comprises the four edges that define the rectangular shape.

The panels 112 of the respective mounts 110 can be attached to the surface on which the images 102 are to be displayed (such as a wall), and then each second member can engage a respective panel, as described above. Each display object 120 can then be moved with respect to the surface and to the other display object, vis-à-vis the movable attachment that is provided between the first member and the mount.

For example, as shown in FIGS. 5A-5H, the two images 102*a*, 102*b* can be mirror images of each other. Each image 102*a*, 102*b*, is disposed on a respective display object 120*a*, 120*b*, which can be independently moved with respect to the other. As shown, in one aspect, the display objects can be polygons, such as the rectangles shown in the figures. Each display object has a respective first peripheral surface, which in one aspect can comprise each of the four outer edges. The images, in a further aspect, can extend to the edges of the display objects.

In one aspect, as shown in the figures, the first display object 120*a* and second display object 120*b* can be moved to maintain a mirrored image registration with respect to the images disposed thereon. For example, in FIG. 5A, the display objects are positioned such that the images are in first positions and in a first registration (relative to each other), wherein the two images 102*a* and 102*b* mirror each other along a first axis of symmetry. As shown, the images can be positioned to substantially abut each other. However, the images can also be displayed in spaced relation to each other. As can be appreciated, when the first image 102*a* and second image 102*b* are positioned in the first positions and first registration, they form one continuous image.

Figure 5A:
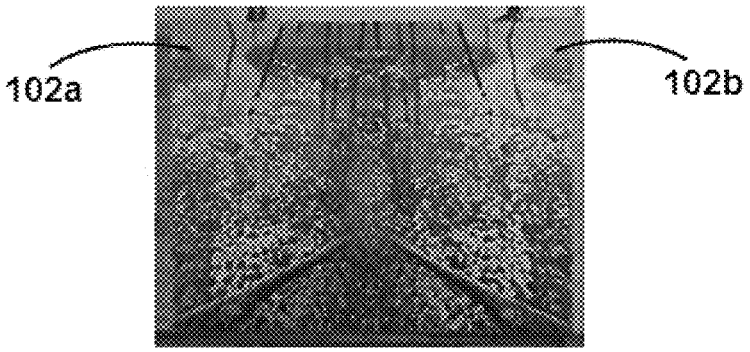
FIGS. 5A-H illustrate two images mounted to exemplary assemblies for displaying images, the images being shown in 8 different registrations.
Figure 5B:
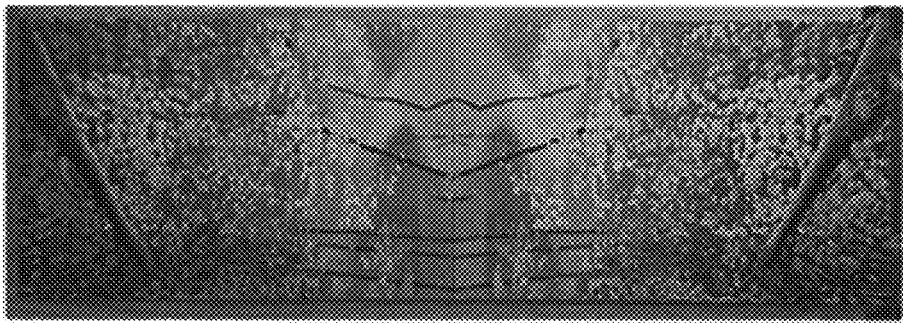
Figure 5C:
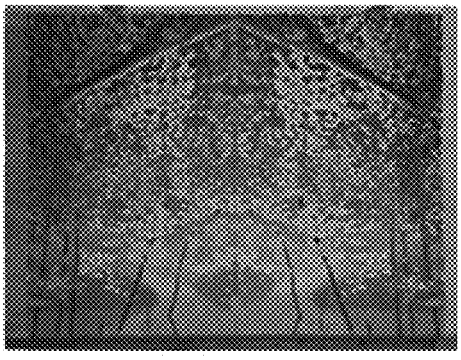
Figure 5D:
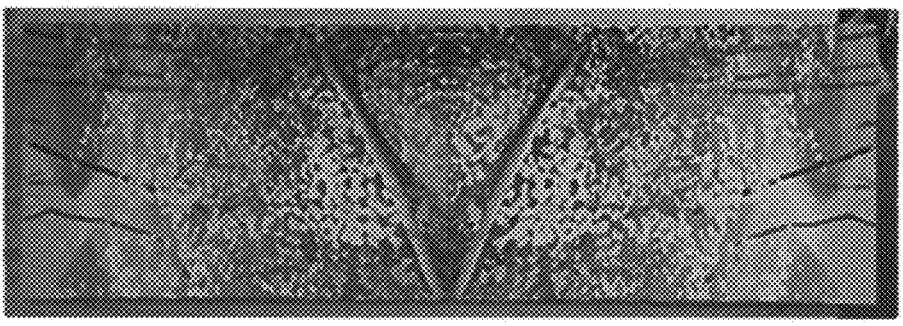
Figure 5E:
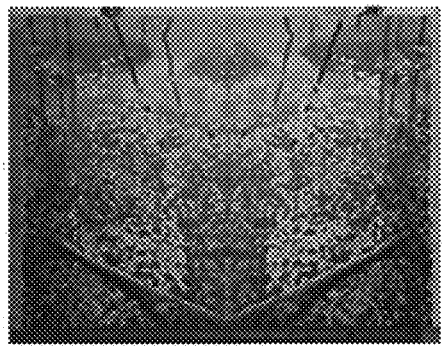
Figure 5F:
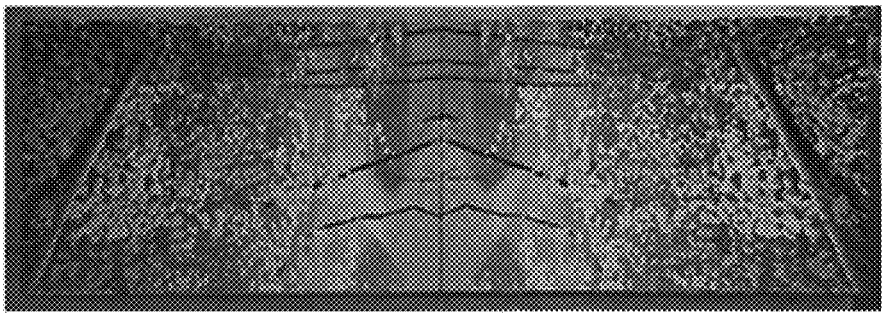
Figure 5G:
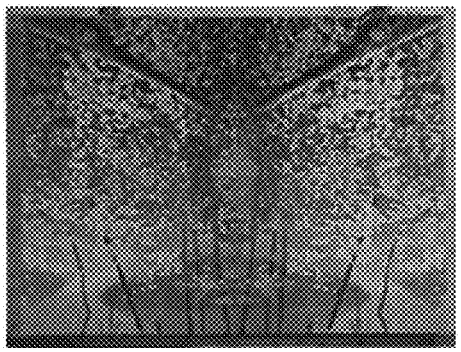
Figure 5H:
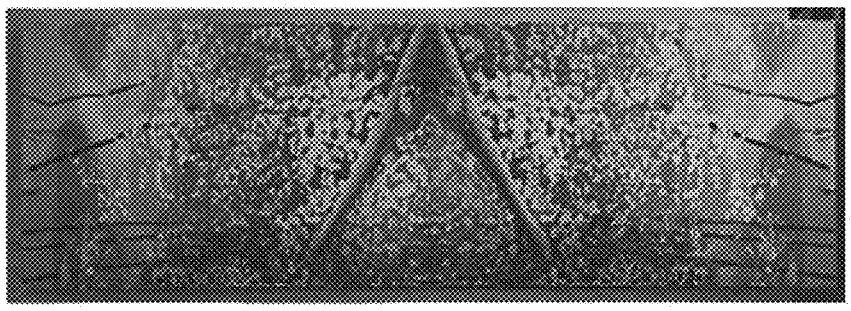

Referring now to FIG. 5B, the images can be counter-rotated 90° (i.e., in opposite directions from each other) and positioned in a second registration such that they mirror each other along a second axis of symmetry. For a four-sided image, the images can be further rotated and positioned in third and fourth registrations (see FIGS. 5C and 5D) to mirror each other along third and fourth axes of symmetry, respectively. The images can, alternatively, be positioned next to each other in the first positions, but in a different registration than the first registration described with respect to FIG. 5A. For example, as shown in FIG. 5E, the images are in the first position but abut each other along the third axis of symmetry. The images can continue to be rotated 90° at a time to and through fifth through eighth registrations (see FIGS. 5F-5H).

In order to be rotated to and through the various positions and registrations shown in FIGS. 5A-5H, it is contemplated that each display object can be slidably moved with respect to its mount, rotated, and then slidably moved again to abut (or be spaced from) the other display object in any desired position. As can be appreciated, each time the display objects, and thus the images, are repositioned and placed in a new registration, a new continuous image is formed, without ever changing the content of the underlying images 102*a*, 102*b* themselves.

According to another embodiment, as shown in FIGS. 6A-6F, an assembly 200 is provided for displaying an image. In this case, a mount 210 is provided that has a general rectangular shape. The mount can be configured to attach to a surface. For example, the mount 210 can be attached to a wall, or can be placed on a horizontal surface such as a table or floor. First and second display objects, 220*a* and 220*b*, are movably attached to the mount and are configured to attach to the images 202*a*, 202*b*, respectively. For example, the display objects 220*a*, 220*b* can be substantially planar and the images 202*a*, 202*b* can be printed directly on the display objects, or otherwise attached to (glued, adhered, stapled, etc.) the display objects.

Figure 6A:
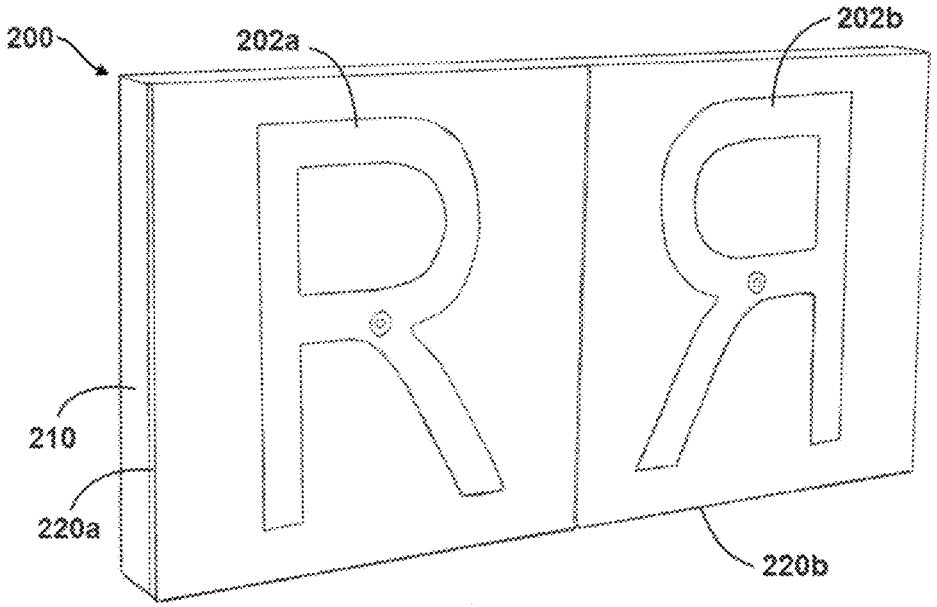
FIG. 6A is a front perspective view of an exemplary assembly for displaying an image, showing two images in a first position of a first registration, according to another embodiment.

As shown in FIGS. 6A-6F, the images are represented by the letter "R," which represents an image that is asymmetric in and of itself. Although the "R" shown does not extend to the edges of each display object, it is contemplated that The two images 202*a*, 202*b* are mirror images of each other and can be positioned on the first members 220*a*, 220*b* in mirrored registration to each other. A first exemplary registration is shown in FIG. 6A. In FIG. 6A, the images are shown abutting each other along a first axis of symmetry.

Figure 6B:
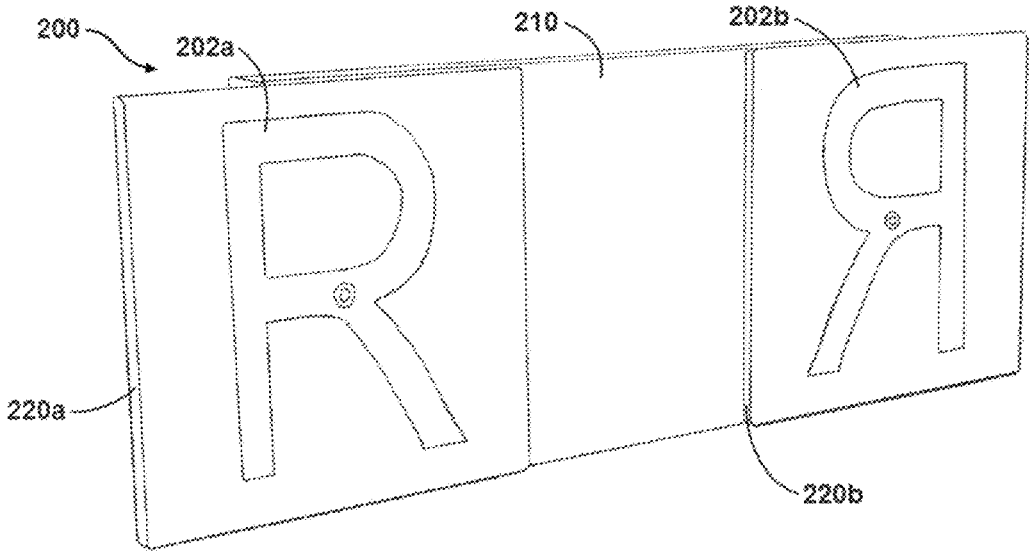
FIG. 6B is a front perspective view of the assembly of FIG. 6A, showing the images in a second position of the first registration.
Figure 6C:
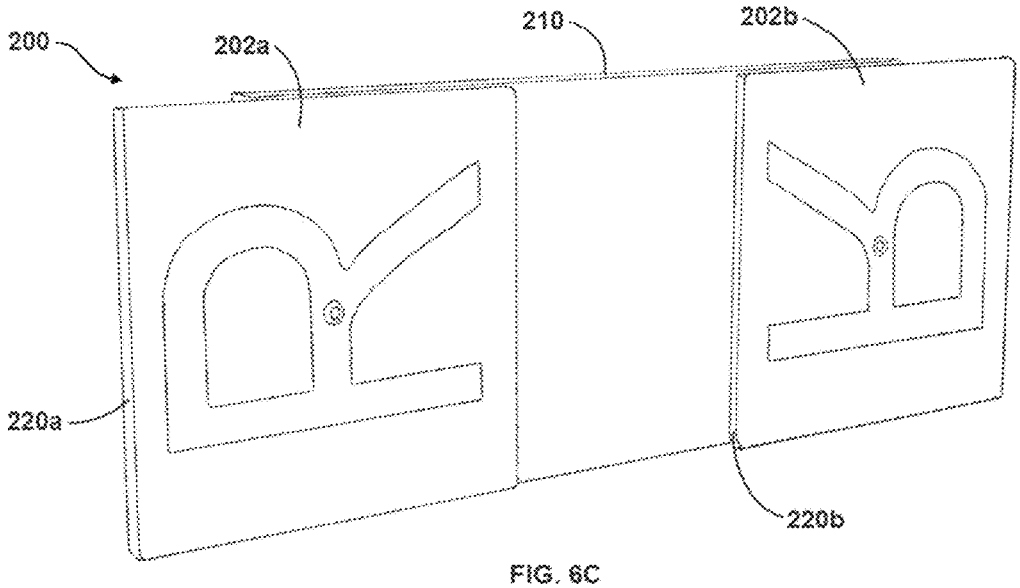
FIG. 6C is a front perspective view of the assembly of FIG. 6A, showing the images in a first position of a second registration.
Figure 6D:
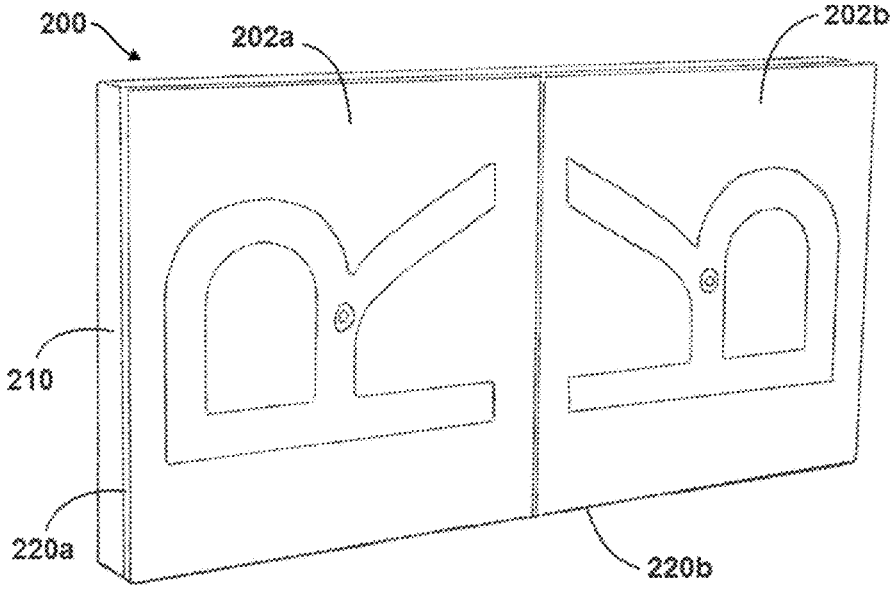
FIG. 6D is a front perspective view of the assembly of FIG. 6A, showing the images in a second position of the second registration.

The display objects 220*a*, 220*b* can be rotatably and slidably attached to the mount 210 such that they can be slid from a first position in FIG. 6A to a second position in FIG. 6B, while maintaining the first registration of the images. In their spaced position of FIG. 6B, the display objects can be counter-rotated 90° to put the images in a second registration relative to each other (FIG. 6C). The display objects can then be pushed back together, as shown in FIG. 6D, such that they abut each other along a second axis of symmetry. It is contemplated that the display objects can continue to be rotated such that the images can be positioned in third and fourth registrations (not shown) to mirror each other along third and fourth axes of symmetry.

Figure 6E:
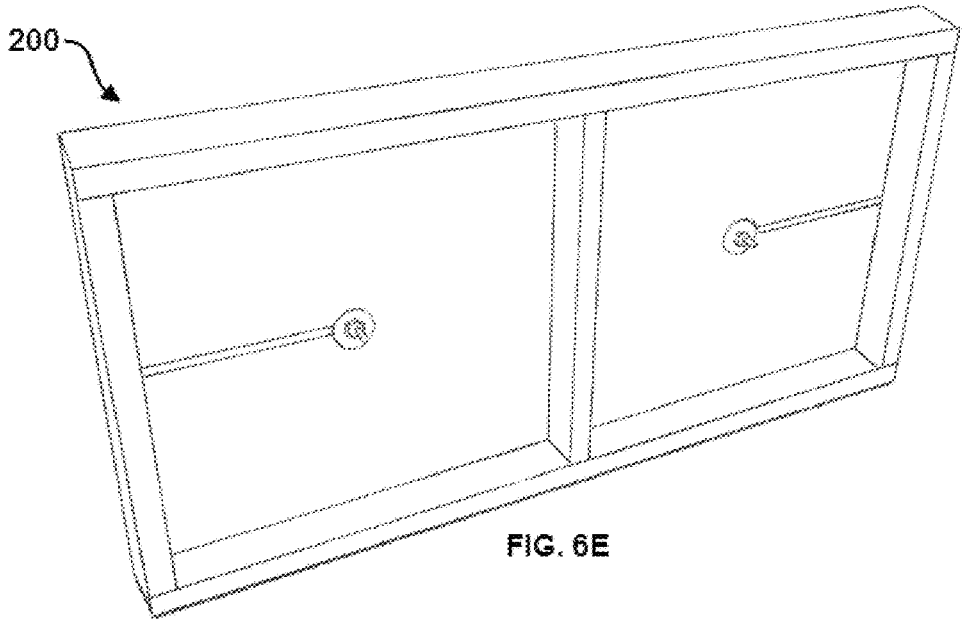
FIGS. 6E and 6F are rear perspective views of the assembly of FIG. 6A, showing the movable attachment of display objects with respect to a mount.
Figure 6F:
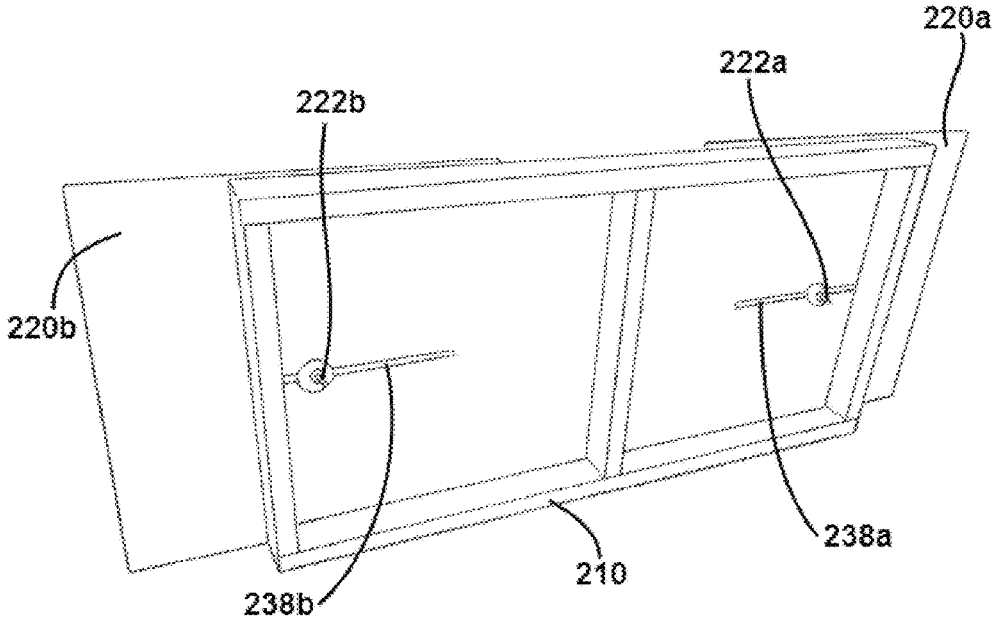

As shown in FIGS. 6E and 6F, the mount can include two grooves 238*a*, 238*b* for receiving a portion, such as a connecting arm 222*a*, 222*b*, of a respective display object 220*a*, 220*b*. The grooves serve as tracks that allow the first members to slide with respect to the panel. As shown in FIGS. 6A-6F, the connecting arms can also serve as pivot points for the display objects to rotate relative to the mount.

Another embodiment of an assembly 300 for displaying an image is shown in FIGS. 7A-7G. This assembly includes a mount 310 that can be a rectangular frame. A plurality of display objects 320 can be movably attached to the amount, and images 302 can be attached to or displayed on each display object. As shown, each image can be asymmetric in and of itself, and can be positioned in mirrored registration to each adjacent image. For example, if four-sided images are used, two different versions of the image can be provided, one being the mirror image of the other.

Figure 7A:
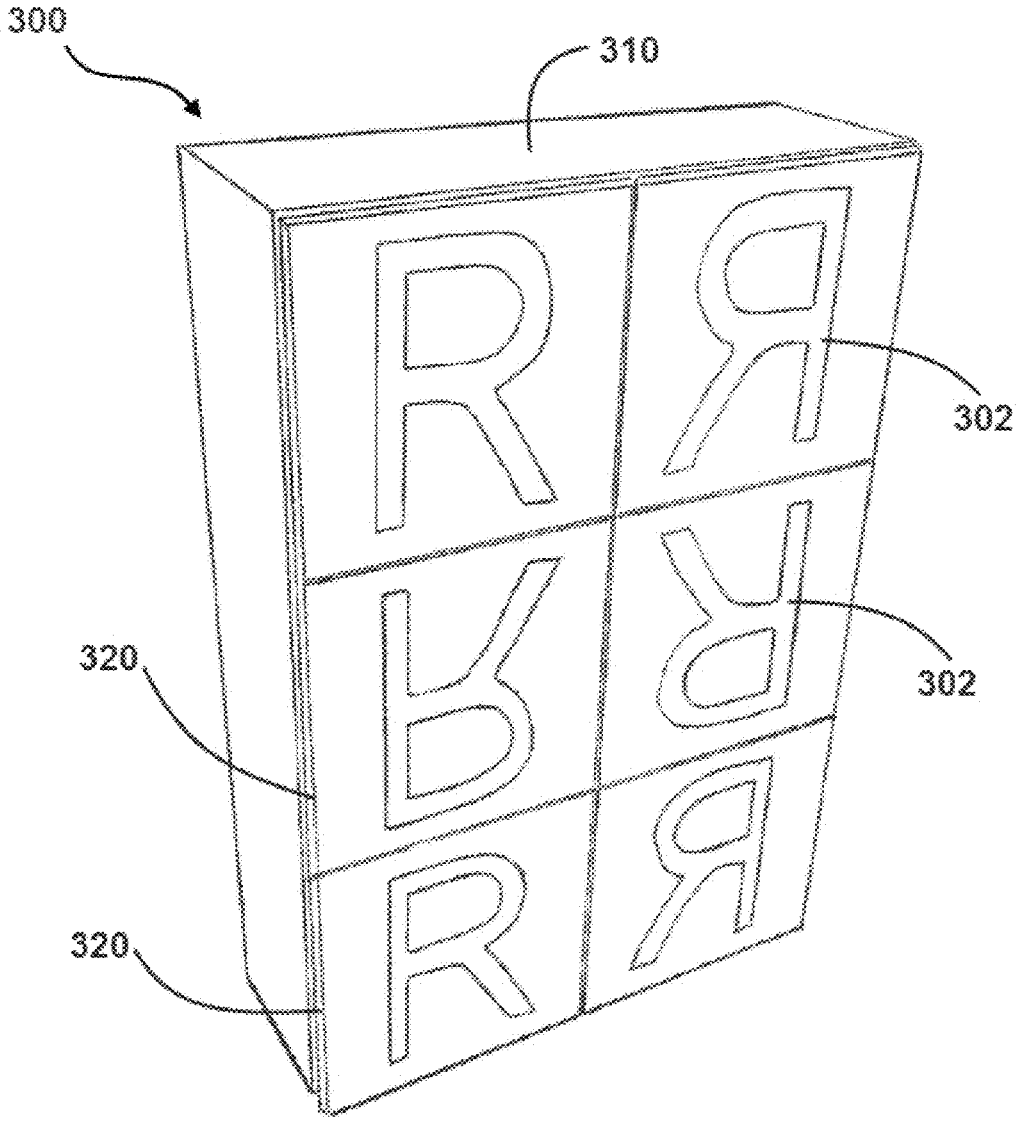
FIG. 7A is a front perspective view of an assembly for displaying an image, showing six images in a first registration.
Figure 7B:
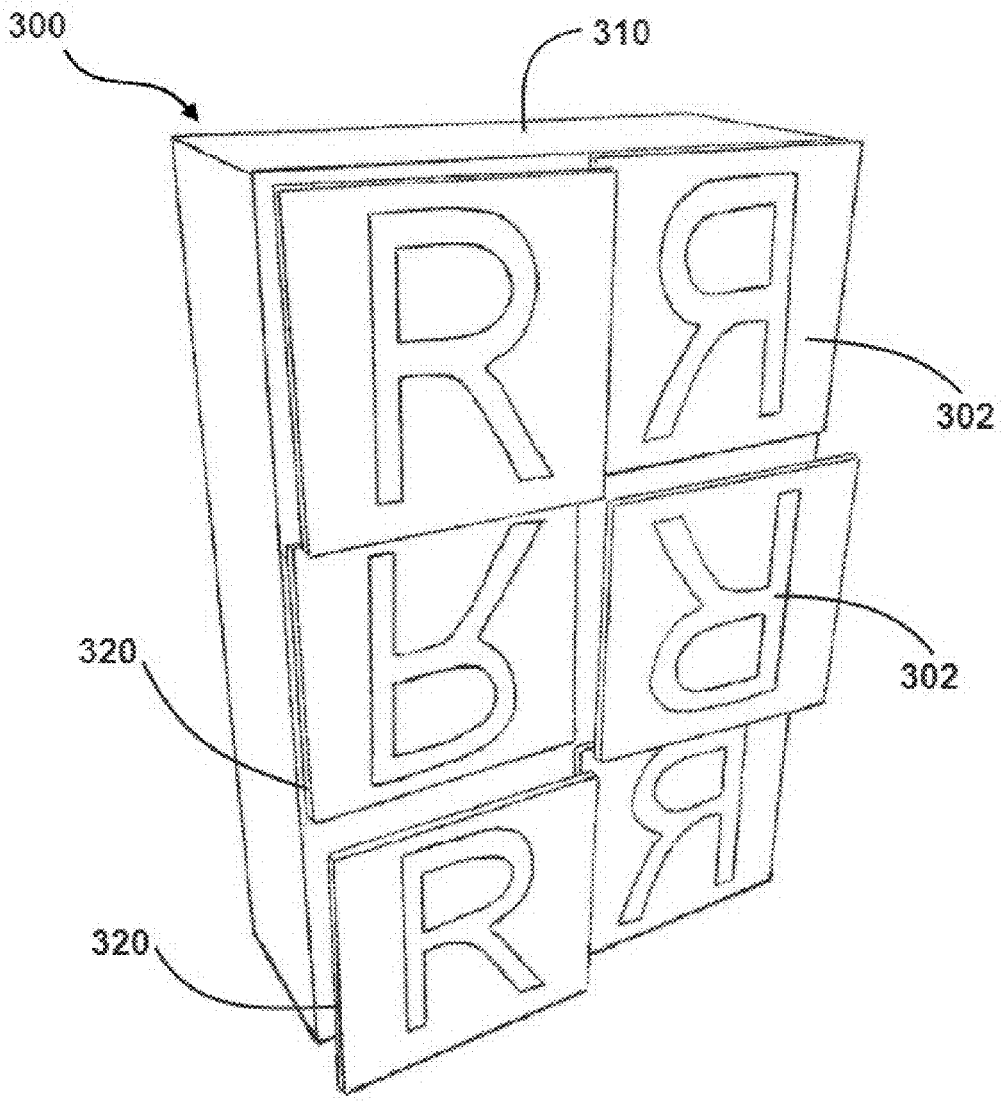
FIG. 7B is a front perspective view of the assembly of FIG. 7A, showing three of the images telescoped outwardly from the assembly.
Figure 7C:
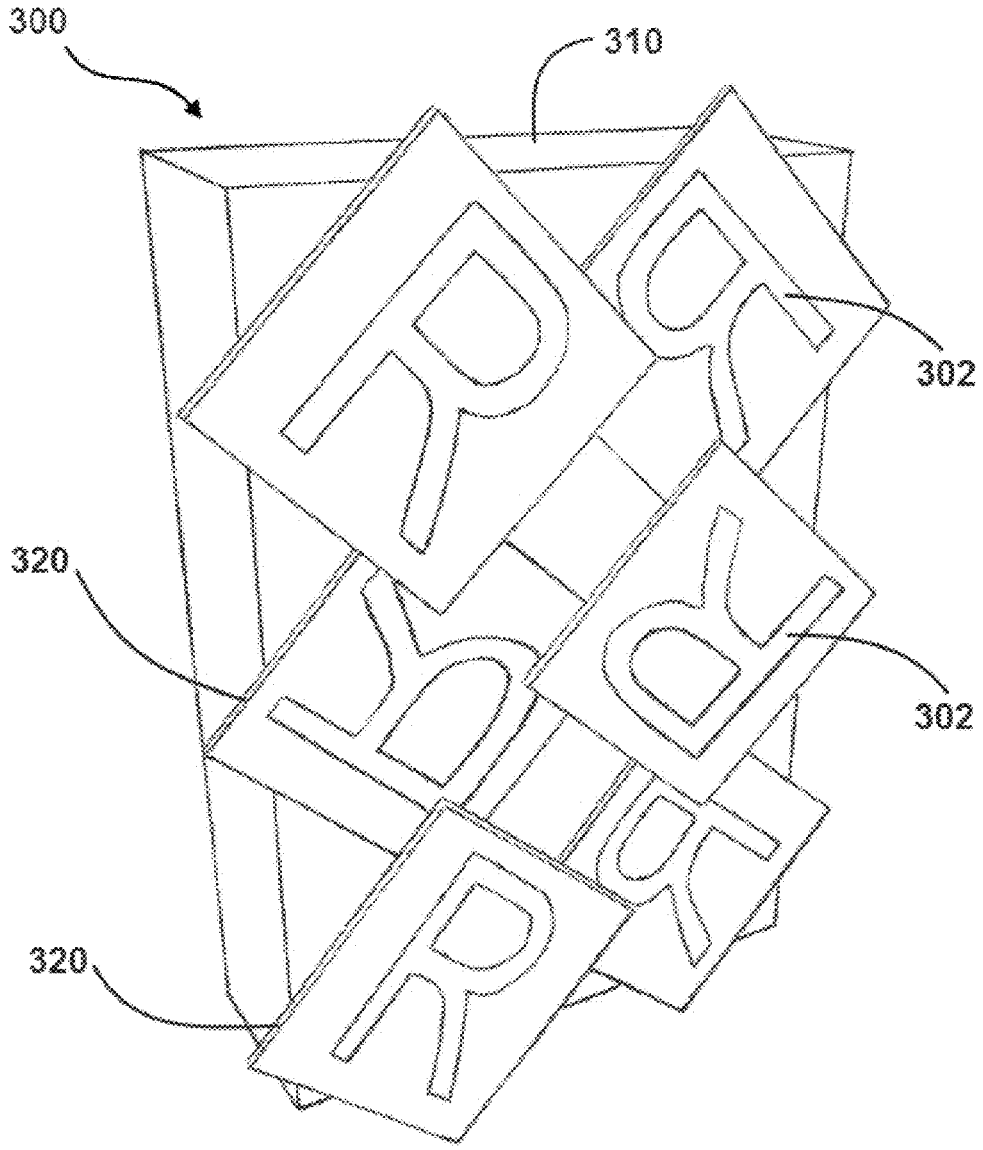
FIG. 7C is a front perspective view of the assembly of FIG. 7A, showing the images being rotated from a first registration to a second registration.
Figure 7D:
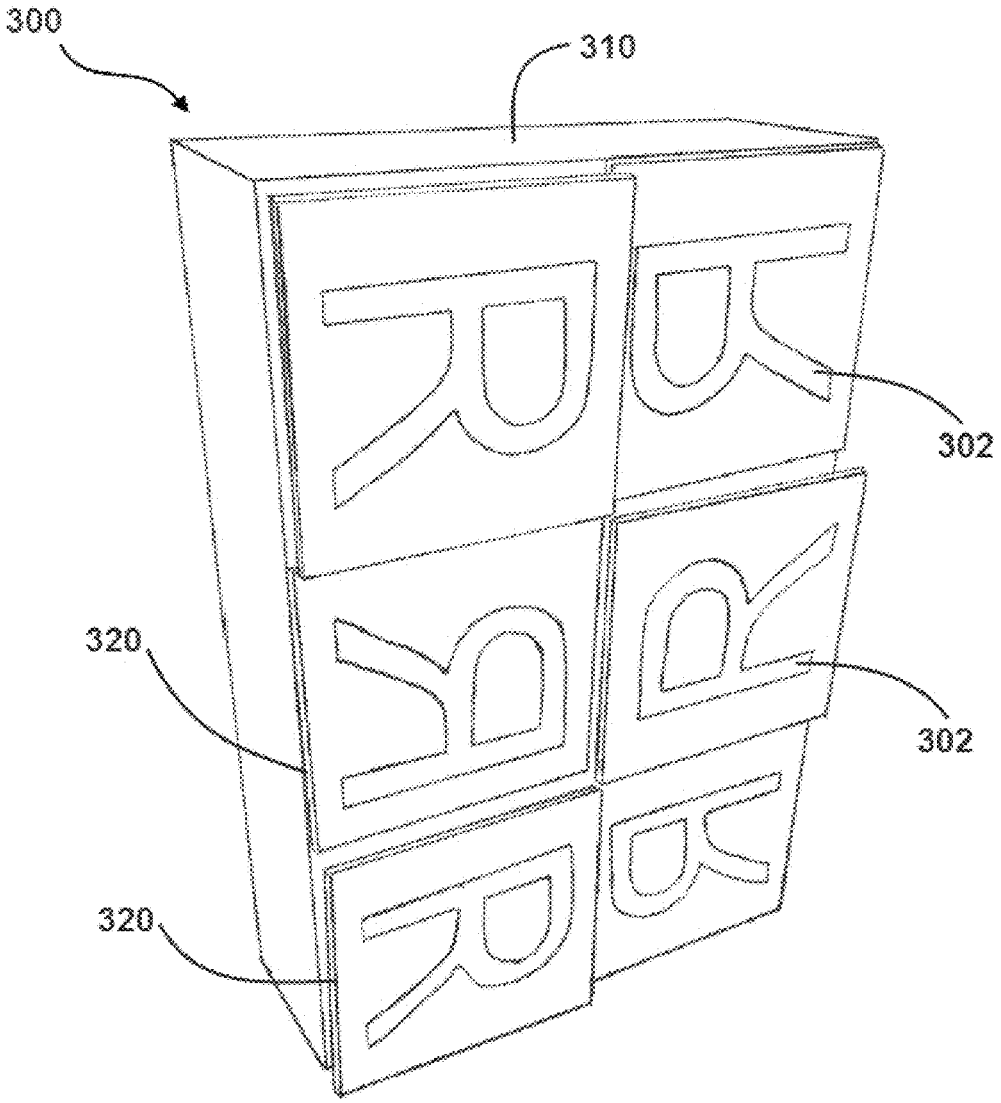
FIG. 7D is a front perspective view of the assembly of FIG. 7A, showing the three of the images telescoped outwardly from the assembly in the second registration.
Figure 7E:
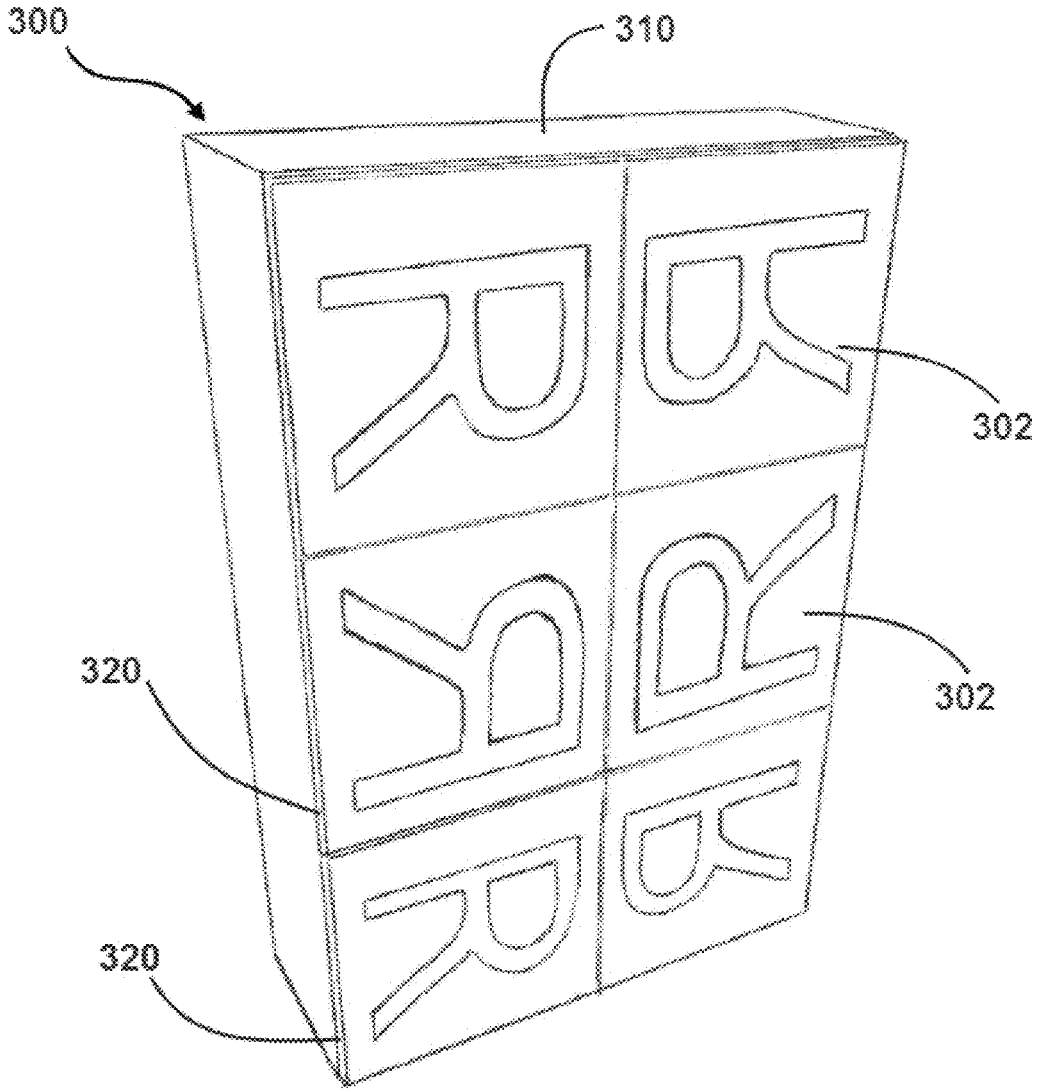
FIG. 7E is a front perspective view of the assembly of FIG. 7A, showing the images in the second registration.

As described above with respect to FIGS. 5A-5H, the individual images 302 form a single continuous image when displayed together. The single continuous image can be changed simply by moving or repositioning the individual images 302 with respect to each other, but without otherwise changing the individual images. For example, as shown in FIG. 7B, several of the display objects 320 can telescope out from the mount 310 to provide space for the display objects to rotate. In some aspects, each display object can be configured to telescope out of the mount and a user can select which display objects to pull out to rotate. Alternatively, preselected display objects (such as in a checkerboard pattern) can be configured to telescope out. Each display object can be rotatably attached to the mount such that each display object can then be rotated. FIG. 7C shows each display object in rotation to move the images from a first registration to a second registration. In FIG. 7D, several display objects are shown telescoped out from the mount. These display objects can be pushed back toward the mount to sit flush with the other display objects such that the images are now displayed in a second registration (FIG. 7E).

Figure 7F:
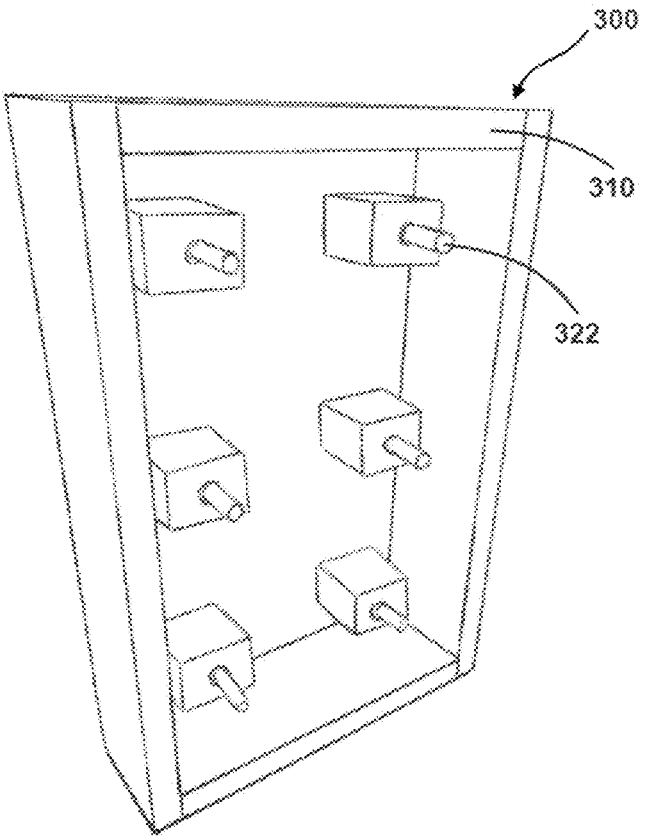
FIG. 7F is a rear perspective view of the assembly of FIG. 7A.
Figure 7G:
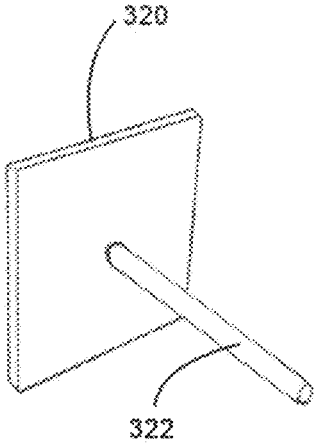
FIG. 7G is a rear perspective view of a telescoping member of the assembly of FIG. 7A.

FIG. 7F illustrates the exemplary 300 from a rear perspective view such that the it can be seen how each display objects 320 is configured to telescope out from the mount 310. An exemplary display object 320 is shown in FIG. 7G, and as can be seen, the display object can comprise a connecting arm 322 that is substantially cylindrical. The connecting arm can extend from the display object at approximately its geometric center to also allow the display object to rotate relative to the mount about its geometric center. Although FIGS. 7A-7F show an assembly 300 for displaying six images, it is contemplated that such an assembly can be provided to display any number of images.

Figure 8A:
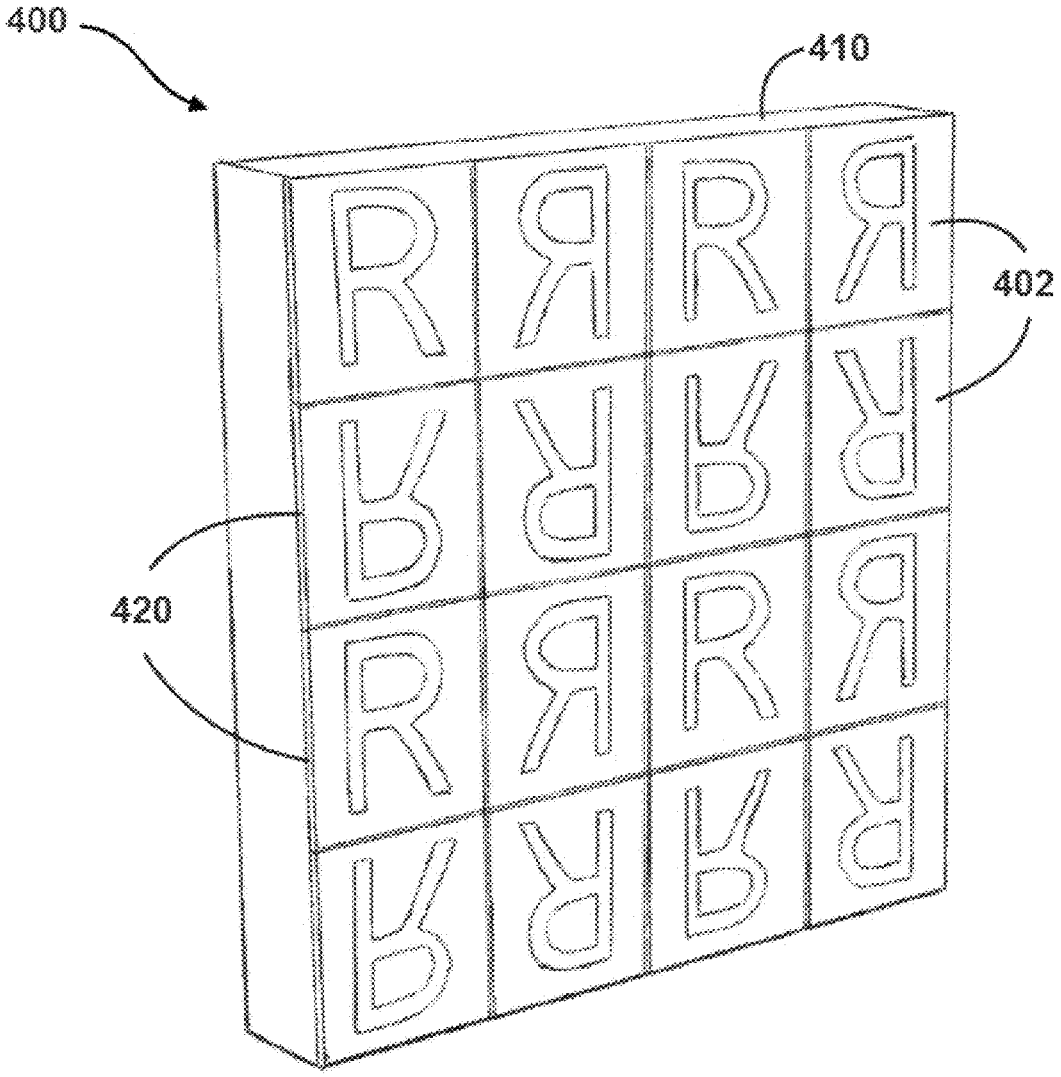
FIG. 8A is a front perspective view of a magnetic assembly for displaying images showing sixteen images in a contiguous arrangement, according to another embodiment.
Figure 8B:
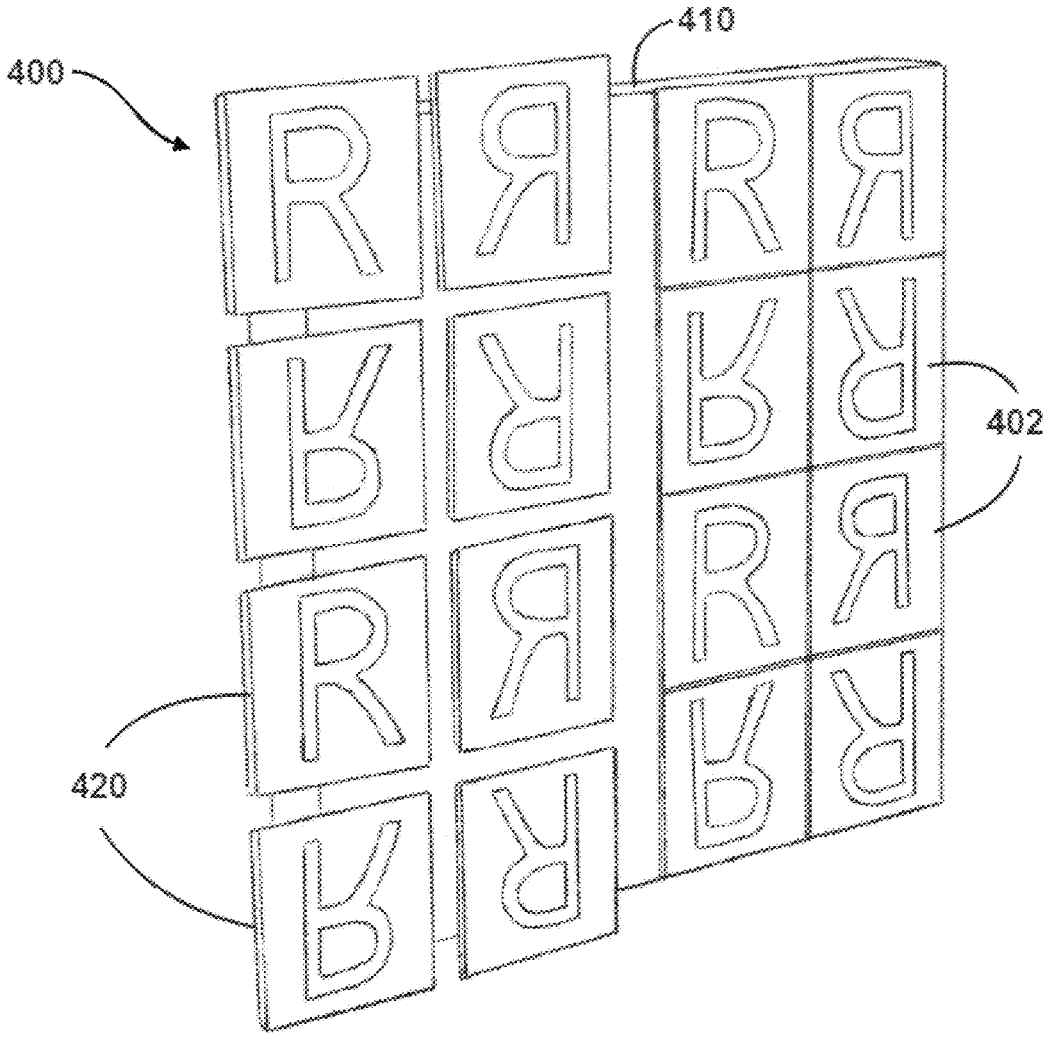
FIG. 8B is a front perspective view of the assembly of FIG. 8A, showing several of the images in a non-contiguous arrangement.

An exemplary assembly 400 for displaying an image is shown in FIGS. 8A-8B, according to another embodiment. This assembly 400 uses magnetic means to display images. Thus, a mount 410 is provided that may have a magnetic front surface. Display objects 420 having images 402 disposed thereon are provided that have magnetic rear surfaces, such that they can be movably and magnetically attached to the mount 410. As shown in FIG. 8A, the images can be asymmetric in and of themselves, and can be positioned in mirrored registration to each adjacent image. As discussed above, two different versions of the four-sided image can be provided, each being the mirror image of the other. As shown in FIG. 8A, sixteen images are provided in this exemplary assembly; however, any number of images can be used. The images can be pushed together to substantially abut each other in a contiguous arrangement, as shown in FIG. 8A. Optionally, all or some of the images can be spaced from one another, as shown in FIG. 8B. As discussed above, the single continuous image formed from the individual images 402 can be changed by rotating and counter-rotating the individual images 402. Although the mount 410 shown is generally a square frame, it is contemplated that the mount can be any item or device having a magnetic surface. For example, a refrigerator with a magnetic door can be used as an exemplary mount in this embodiment.

Figure 9A:
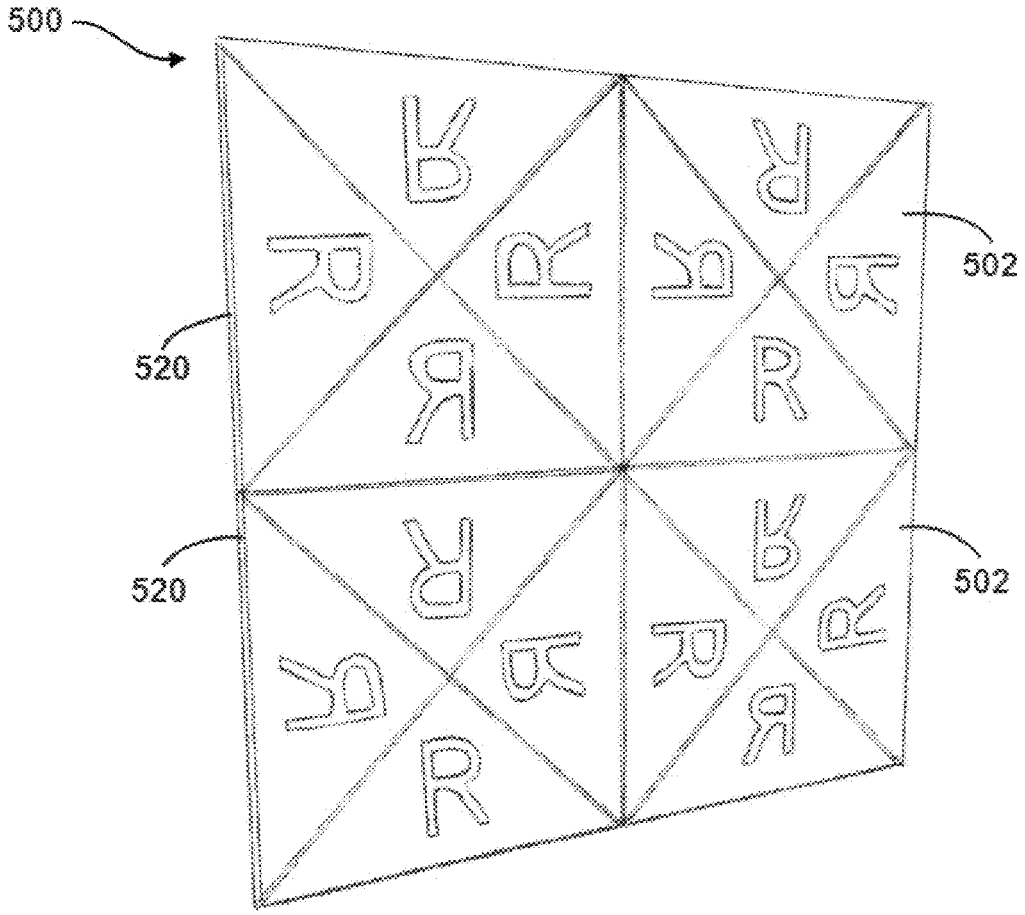
FIG. 9A is a front perspective view of a magnetic assembly for displaying images showing sixteen images in a contiguous arrangement, according to yet another embodiment.
Figure 9B:
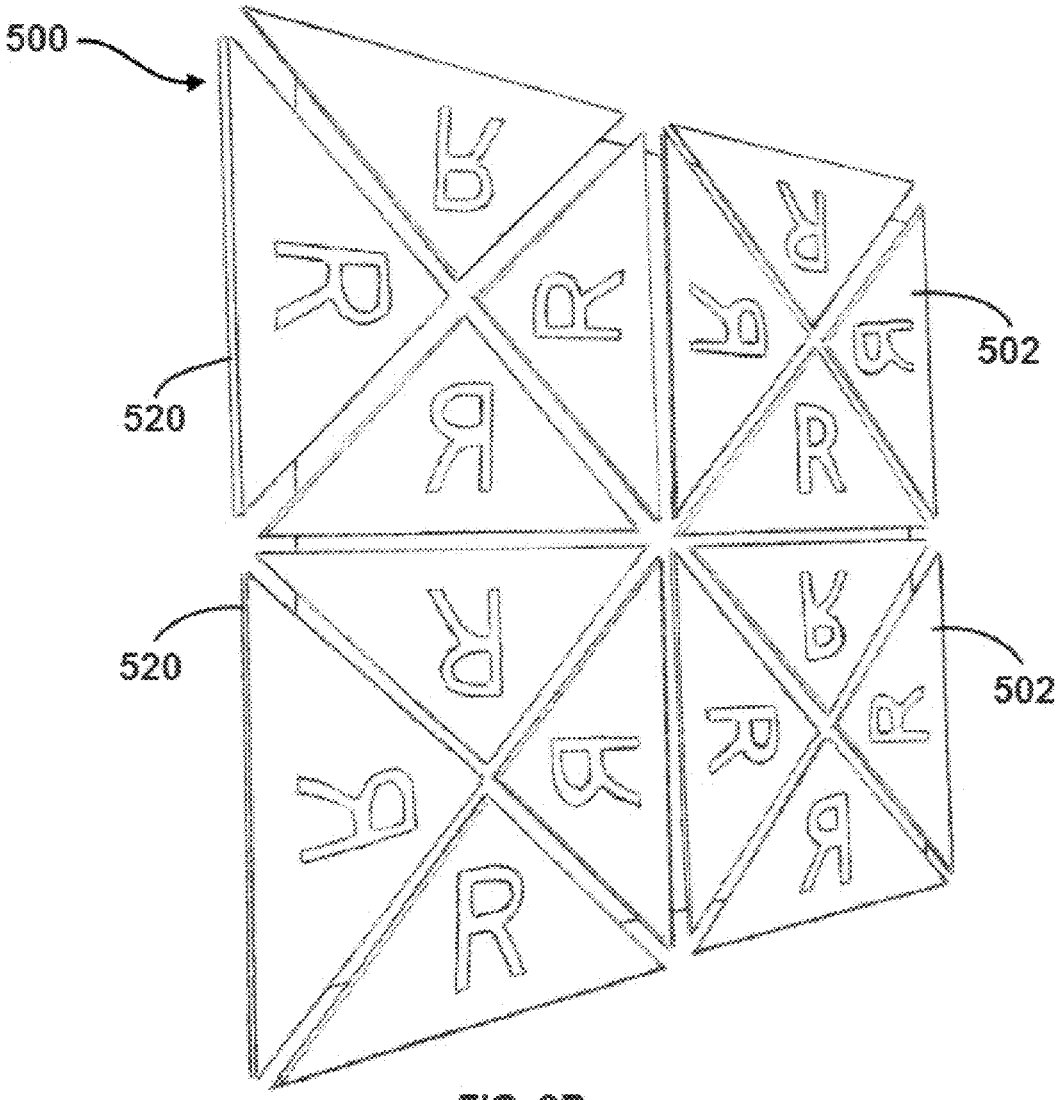
FIG. 9B is a front perspective view of the assembly of FIG. 9A, showing the images in a non-contiguous arrangement.

A similar assembly 500 is provided as shown in FIGS. 9A and 9B; however, the images used in this embodiment are three-sided. Thus, two different versions of the images 502 are provided such that each image is a mirror-image of an adjacent image about an axis of symmetry defined by the edge of the image. As discussed above, the display objects 520 can be attached to the mount 510 such that the images 502 are in a contiguous arrangement (FIG. 9A). Optionally, some or all of the display objects can be spaced from each other, as shown in FIG. 9B.

Figure 10A:
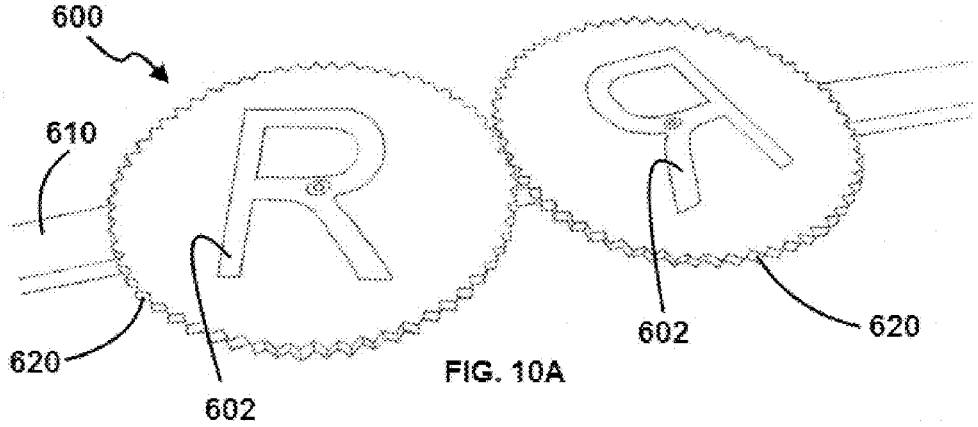
FIG. 10A is a perspective view of a geared assembly for displaying an image, showing the images in a first registration, according to another embodiment.
Figure 10B:
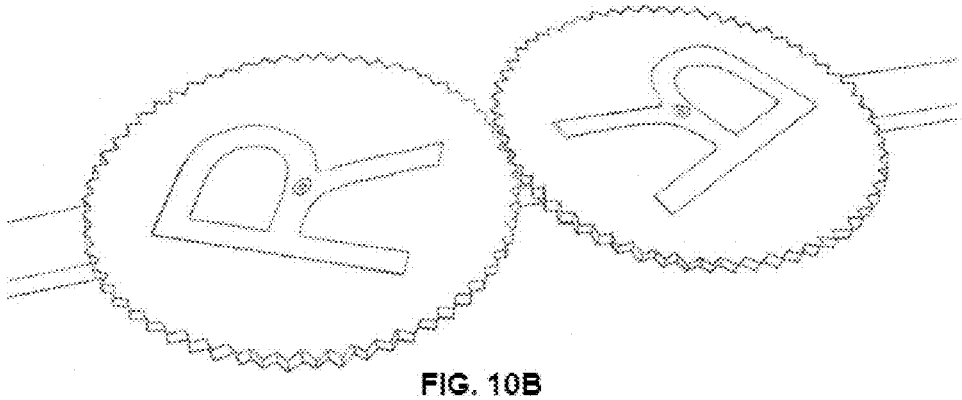
FIG. 10B is a perspective view of the geared assembly of FIG. 10A, showing the images in a second registration.
Figure 10C:
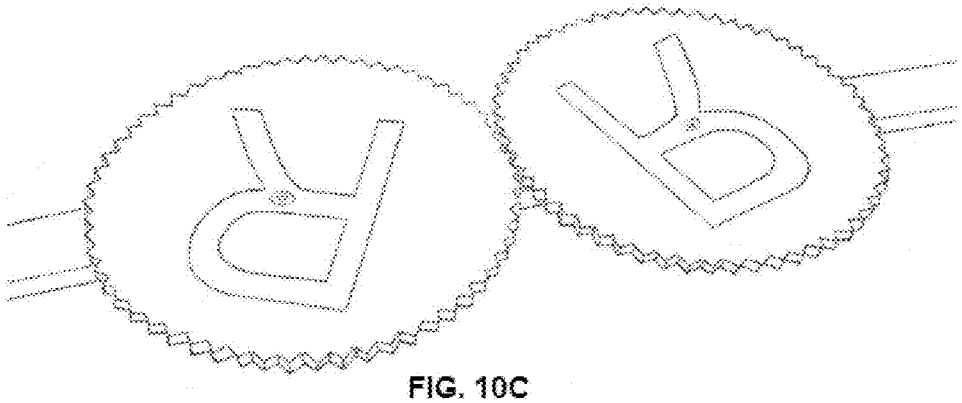
FIG. 10C is a perspective view of the geared assembly of FIG. 10A, showing the images in a third registration.

Yet another embodiment of an assembly 600 for displaying an image is shown in FIGS. 10A-10C. In this assembly 600, each display object 620 can be a gear with an image 602 displayed thereon. Each display object can be rotatably attached to the mount 610 such that adjacent display objects are in geared communication with each other. Thus, the rotation of one display object causes counter rotation in an adjacent display object. The images 602 can then be rotated through an infinite number of mirrored image registrations. Although shown in FIGS. 10A-10C as only two gears, it is contemplated that any number of gears can be provided.

Figure 11A:
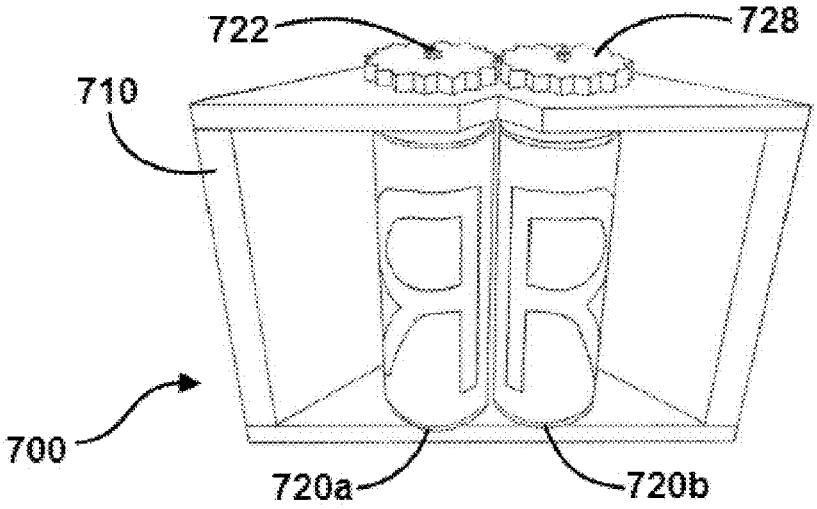
FIG. 11A is a front perspective view of a cylindrical assembly for displaying images, showing the images in a first registration, according to another embodiment.
Figure 11B:
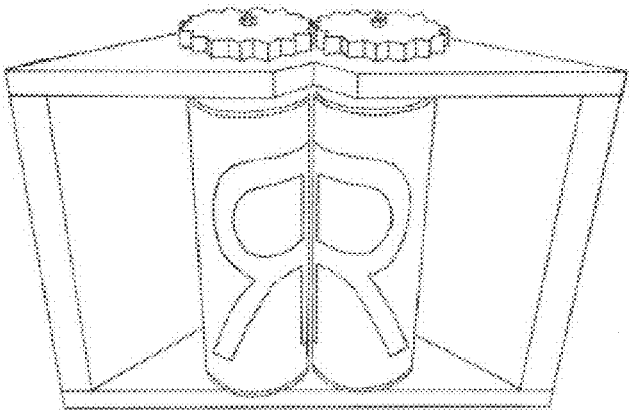
FIG. 11B is a front perspective view of the cylindrical assembly of FIG. 11A, showing the images in a second registration.
Figure 11C:
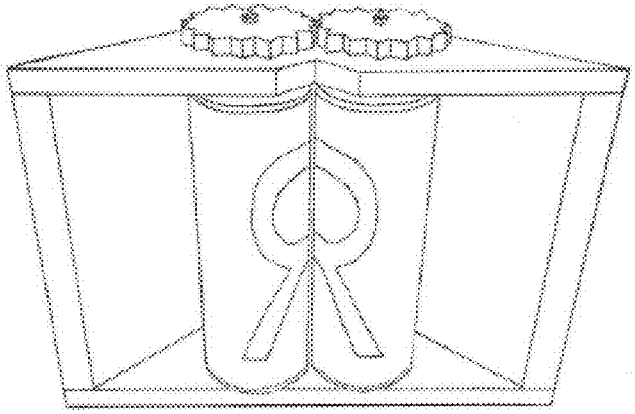
FIG. 11C is a front perspective view of the cylindrical assembly of FIG. 11A, showing the images in a third registration.
Figure 12A:
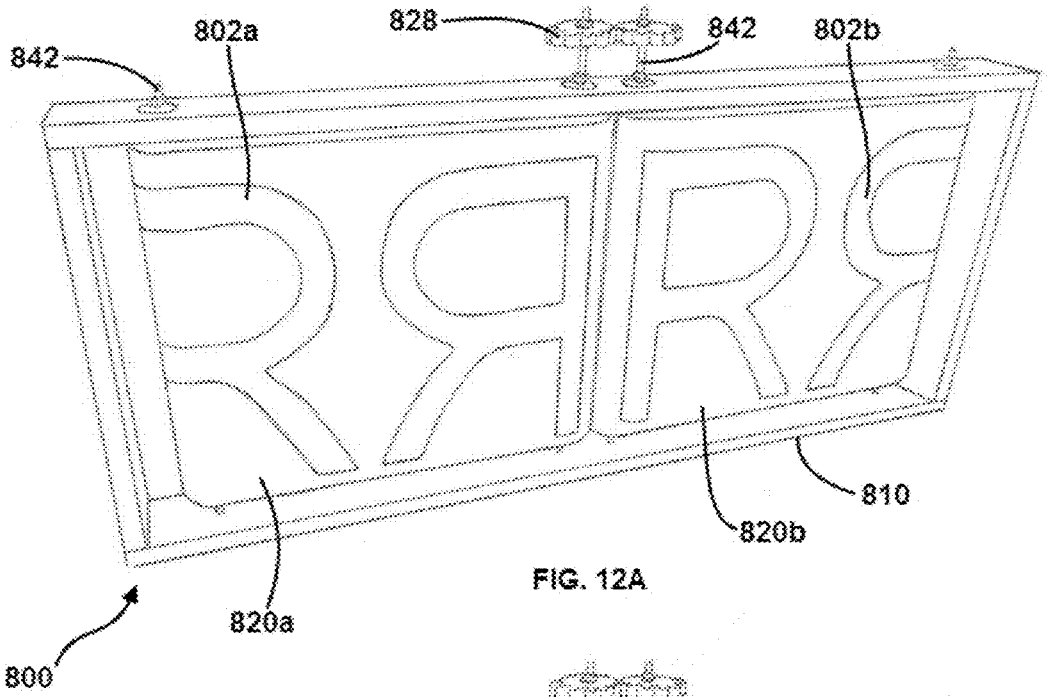
FIG. 12A is a front perspective view of a scroll assembly for displaying images, showing the images in a first registration, according to yet another embodiment.
Figure 12B:
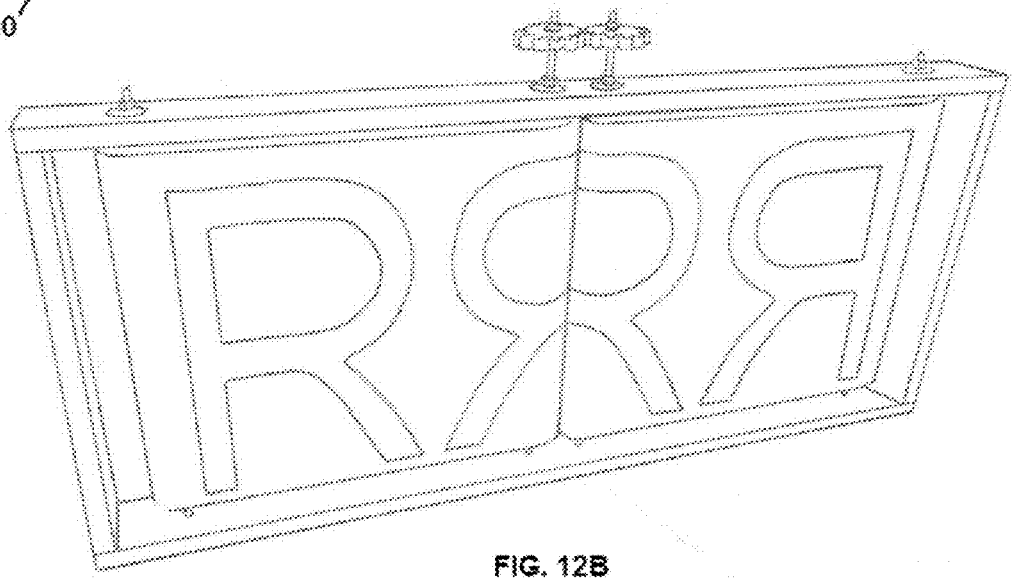
FIGS. 12B-12E are front perspective views of the scroll assembly of FIG. 12A showing the images in alternative registrations.
Figure 12C:
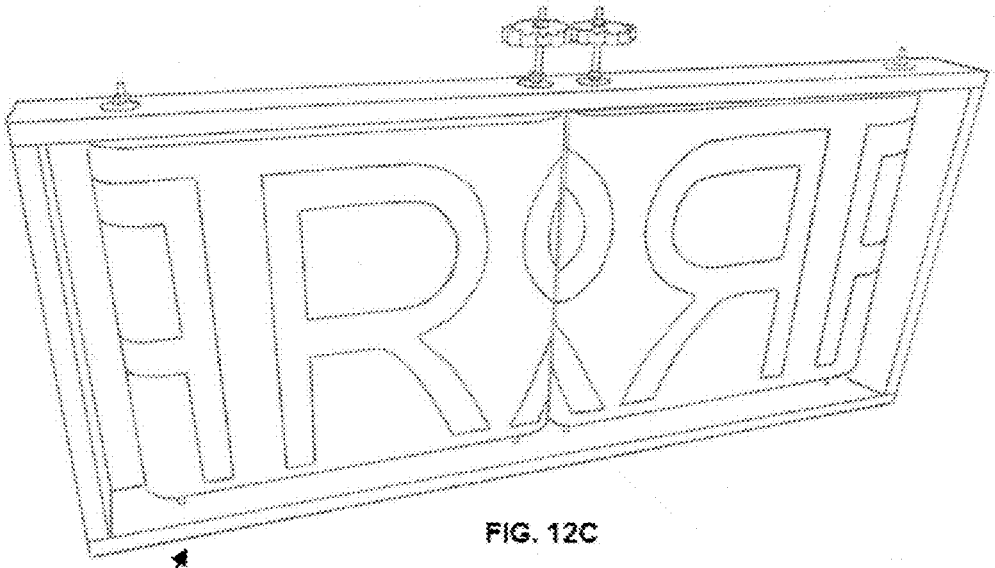
Figure 12D:
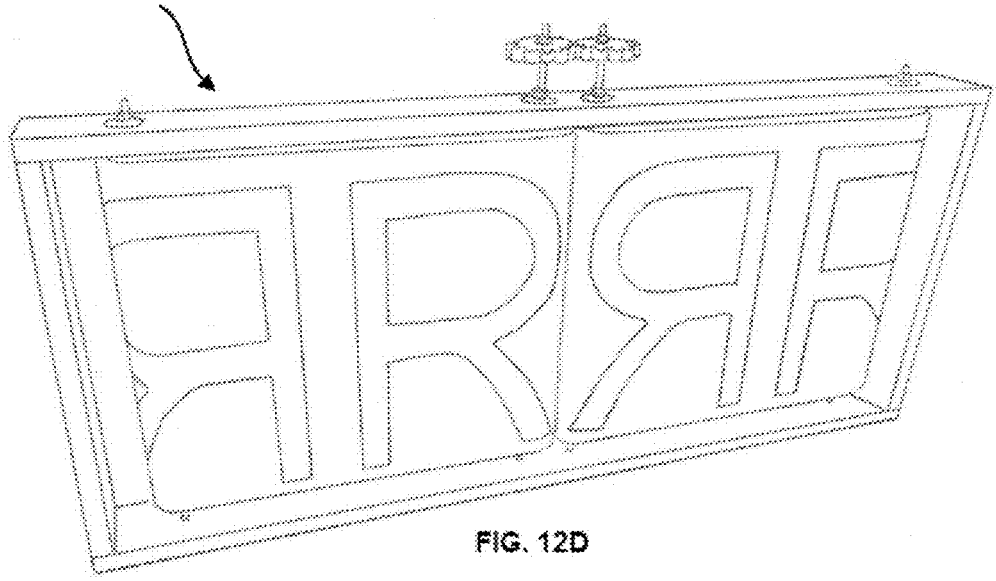
Figure 12E:
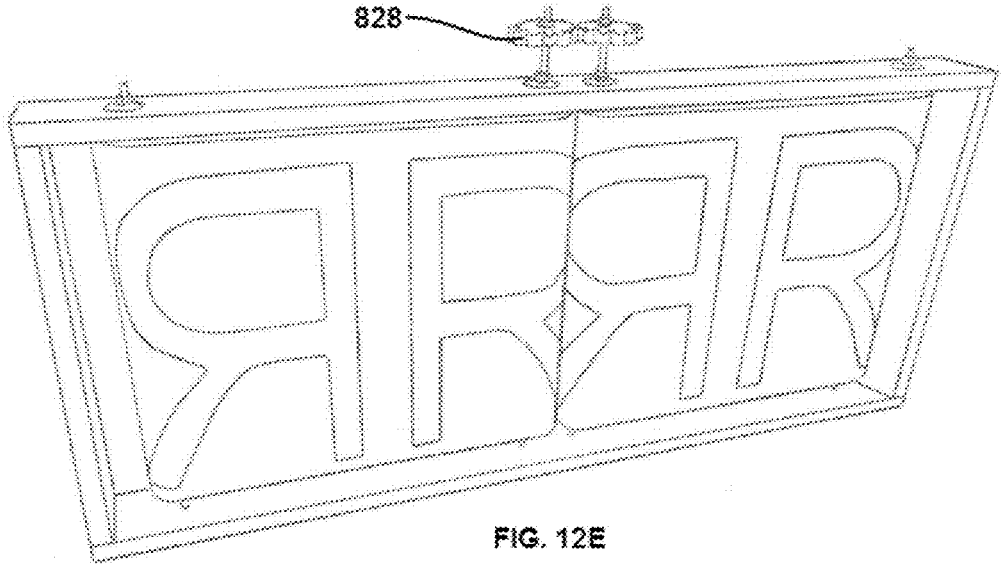
Figure 12F:
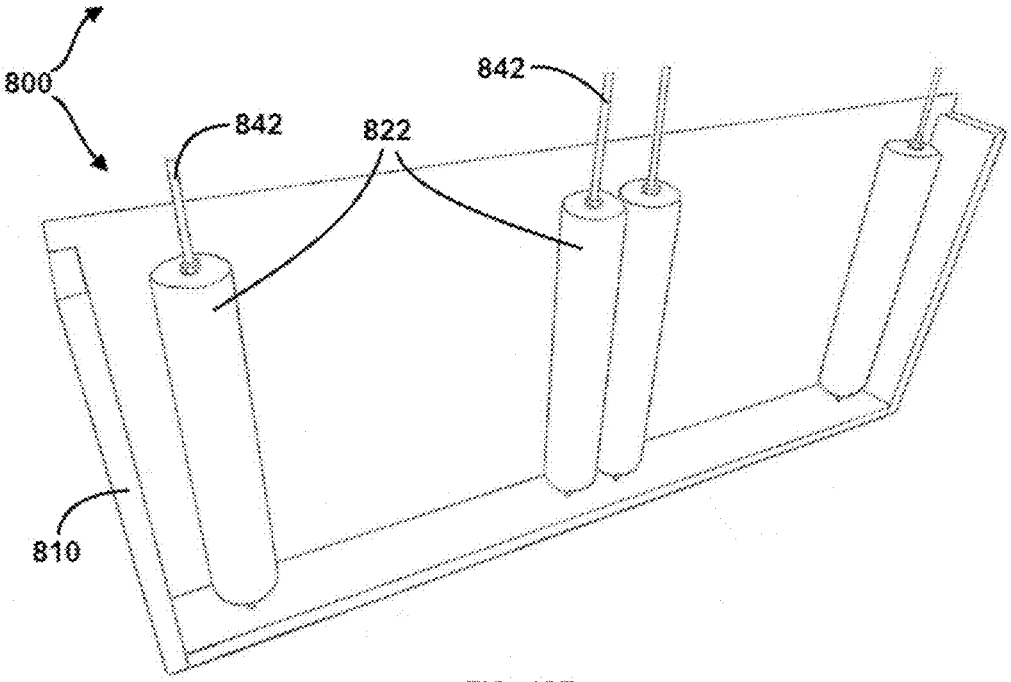
FIG. 12F is a rear perspective, partially disassembled, view of the scroll assembly of FIG. 12A.

FIGS. 11A-C illustrate yet another embodiment of an assembly 700 for displaying images. As can be seen, the mount 710 can be a housing that contains first and second display objects 720*a*, 720*b*. The display objects are substantially cylindrical and have first and second images 702*a*, 702*b* disposed on the curved surfaces thereof. The images 702*a*, 702*b* are mirror images of each other. As can be seen, the display objects 720 are rotatably attached to the mount 710 with the use of a rod 722 that extends along a central axis of each cylinder. Gears 728 are attached to the tops of each rod and allow the display objects to counter rotate with respect to each other. As can be seen in FIGS. 11A-C, as the display objects rotate, the images rotate through an infinite number of registrations relative to each other.

Yet another embodiment of an assembly 800 for displaying images is shown in FIGS. 12A-F. The mount 810 can be a housing that contains first and second display objects 820*a*, 820*b*, which are movably attached to the mount. Each display object comprises a scroll on which first and second images are disposed, along with rotating cylinders 822 about which the scrolls can rotate. All of the cylinders are mounted on and rotate about posts 842 that are rotatably attached to the mount 810, as can be seen in the partially disassembled view of FIG. 12F. The innermost cylinders are mounted on posts, which are connected to gears 828 as described above with regard to FIGS. 11A-C. Thus, the display objects are configured to counter rotate with respect to each other. As can be appreciated, as the display objects rotate, the images rotate through an infinite number of registrations relative to each other.

Figure 13A:
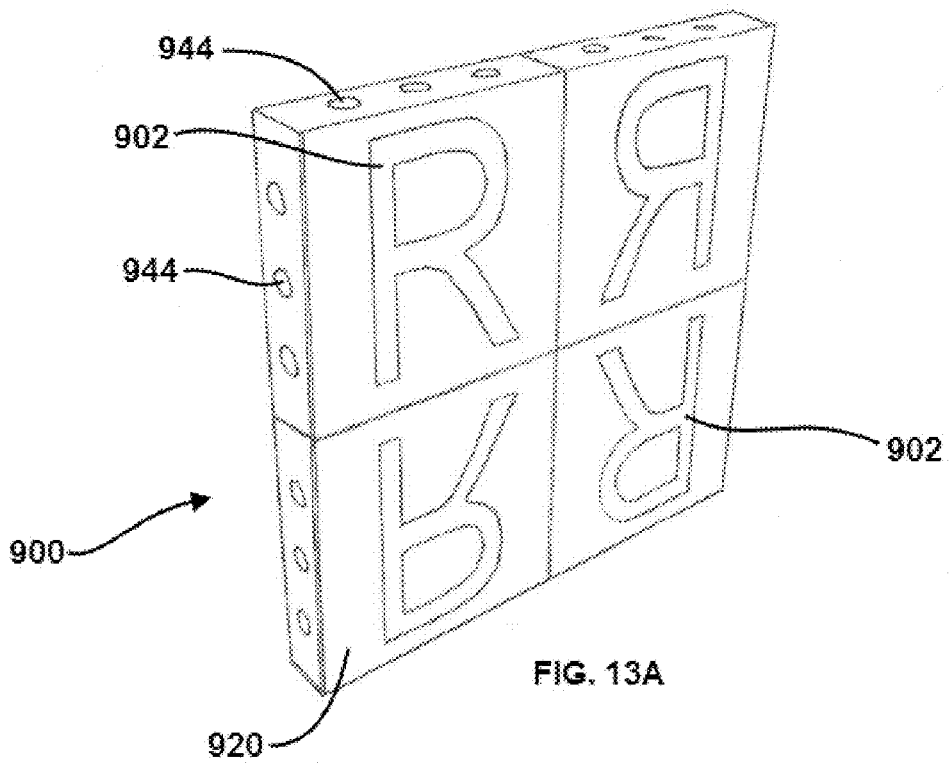
FIG. 13A is a front perspective view of a magnetic assembly for displaying images, according to another embodiment.
Figure 13B:
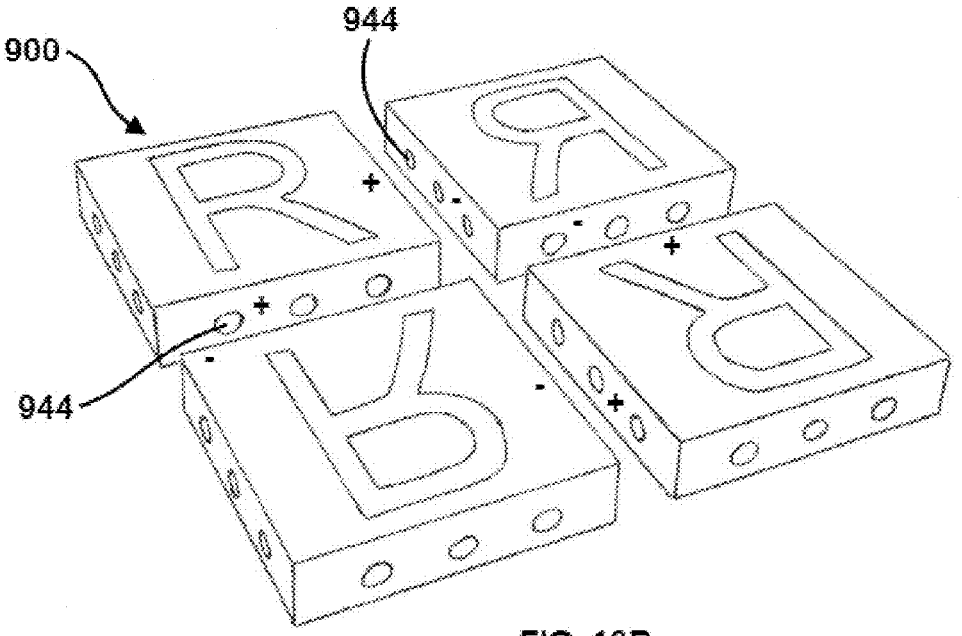
FIG. 13B is a front perspective, exploded view of the assembly of FIG. 13A.
Figure 13C:
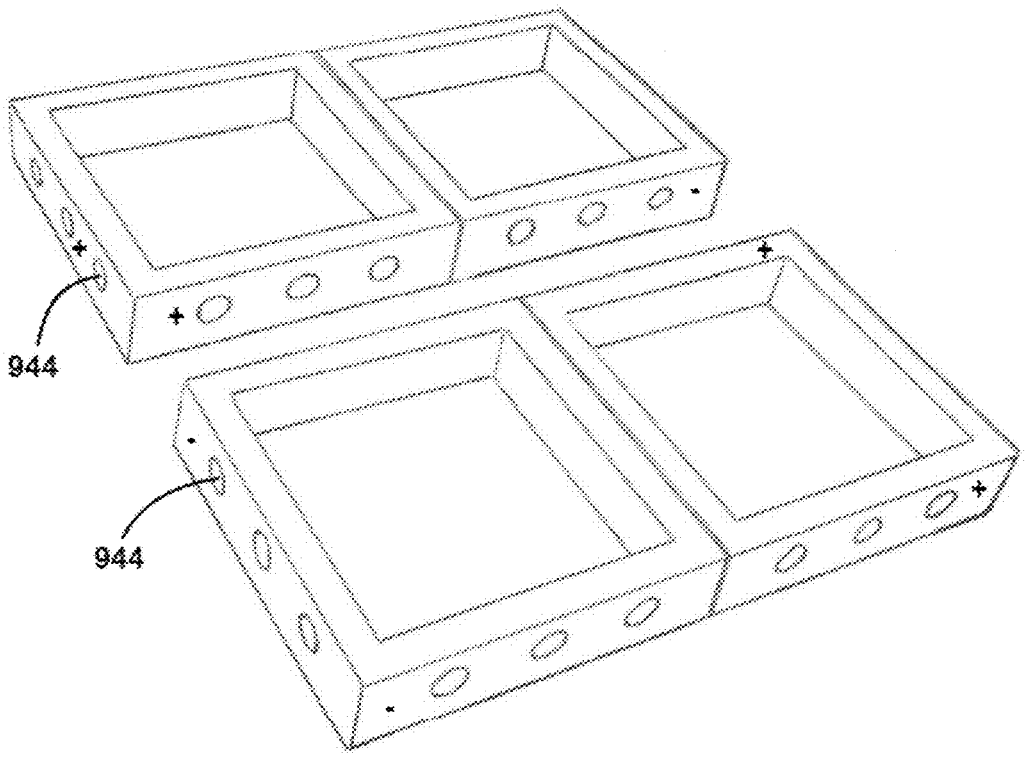
FIG. 13C is a rear perspective, partially exploded view of the assembly of FIG. 13A.

FIGS. 13A-13C illustrate an exemplary assembly 900 for displaying images. In this embodiment, the images 902 are disposed on square display objects 920 that are frames with magnets 944 positioned in each of their outer edges. The magnets on one edge are positively polarized (denoted by "+" in the figures), while the magnets on an adjacent edge are negatively polarized (denoted by "−" in the figures). By arranging the images in a particular manner, it can be assured that the display objects will be magnetically attracted to each other in such a way that the images will be displayed in mirrored registration, as shown in FIG. 13A.

It is contemplated that any of the assemblies described herein can be manipulated manually by a user, or can be manipulated by electromechanical means. The assemblies can be automated to manipulate the position and registration of the images in on a regular, continuous manner, or on a schedule. For example, the assemblies can be configured to display the images in a first registration for a certain period of time, and then manipulate the images to display them in a second registration for a certain period of time. Such automation can be prescheduled, and/or can be chosen or selected by a user, such as with the use of a remote control or similar device.

As can be appreciated, the above-described methods and assemblies provide an entertaining experience for a user by allowing the user to interact with and manipulate what has been thought of as traditionally "stagnant" media, such as images, paintings, sketches, etc. The assemblies and methods described herein also have the advantage of amusing and surprising a user. There is an element of surprise as the user rotates and manipulates the images described herein to create a new single continuous image or composition. The assemblies described herein can also be used as games or puzzles, which can provide additional entertainment to a user.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An assembly for displaying at least one image on a surface, comprising:

a display object on which the image is disposed comprising a first member;

a mount comprising:

a panel that is configured to attach to the surface; and a second member that is configured to matingly engage the panel, wherein the second member comprises a groove; and wherein the first member of the display object is movably and rotatably attached to the second member of the mount.

2. The assembly of claim 1, wherein the panel comprises a first surface, and wherein the second member comprises at least one mating surface that is configured to engage the first surface of the panel.

3. The assembly of claim 2, wherein the first surface defines at least one bore.

4. The assembly of claim 3, wherein the mating surface comprises at least one post that is sized and shaped to be received by the at least one bore.

5. The assembly of claim 1, wherein the display object is rotatably attached to the mount.

6. The assembly of claim 1, wherein the display object is slidably attached to the grove of the second member of the mount.

7. The assembly of claim 1, wherein the first member is slidably attached to the grove of the second member of the mount and configured to slide along the second member of the mount.

8. The assembly of claim 1, further comprising a connecting arm that extends from the first member and comprises a pin and a head, wherein the head is positioned at one end of the pin distal from the display object, and wherein the groove of the second member of the mount is configured to slidably receive at least a portion of the connecting arm.

9. The assembly of claim 8, wherein the head has a width that is greater than a width of the pin, wherein the groove is a C-shaped groove taken in cross-section, such that an opening of the groove has a first dimension that is smaller than a dimension of an inner portion of the groove, and wherein the groove is sized and shaped to receive and retain the head of the connecting arm.

* * * * *